US012808547B2

(12) United States Patent
Kim et al.

(10) Patent No.: US 12,808,547 B2
(45) Date of Patent: Nov. 24, 2026

(54) COOKING APPARATUS

(71) Applicant: Samsung Electronics Co., Ltd., Suwon-si (KR)

(72) Inventors: Sangjin Kim, Suwon-si (KR); Sangjin Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 372 days.

(21) Appl. No.: 18/411,901

(22) Filed: Jan. 12, 2024

(65) Prior Publication Data

US 2024/0247811 A1 Jul. 25, 2024

Related U.S. Application Data

(63) Continuation of application No. PCT/KR2023/022000, filed on Dec. 29, 2023.

(30) Foreign Application Priority Data

Jan. 20, 2023 (KR) ..... 10-2023-0008915

(51) Int. Cl.
*F24C 15/10* (2006.01)
*F24C 15/20* (2006.01)

(52) U.S. Cl.
CPC ..... *F24C 15/2042* (2013.01); *F24C 15/101* (2013.01); *F24C 15/2035* (2013.01)

(58) Field of Classification Search
CPC . F24C 15/2042; F24C 15/101; F24C 15/2035
(Continued)

(56) References Cited

U.S. PATENT DOCUMENTS 2,401,330 A * 6/1946 Breese ..... F24H 3/006 126/116 B
10,006,641 B2 6/2018 Bruckbauer
10,718,528 B2 7/2020 Bruckbauer
10,782,030 B2 9/2020 Gargiulo et al.
11,168,893 B2 11/2021 Bussotto et al.
11,193,675 B2 12/2021 Neunhäuserer et al.
(Continued)

FOREIGN PATENT DOCUMENTS

CN 217423376 U 9/2022
CN 217978967 U 12/2022
(Continued)

OTHER PUBLICATIONS

International Search Report dated Apr. 24, 2024 for International Application No. PCT/KR2023/022000.
(Continued)

*Primary Examiner* — Avinash A Savani
(74) *Attorney, Agent, or Firm* — STAAS & HALSEY LLP

(57) ABSTRACT

A cooking apparatus including a cooktop including an inlet; a chamber housing to which a duct is connectable, the chamber housing coupled to the cooktop to form a chamber under the inlet; and a fan device inside the chamber housing, the fan device including a fan and a fan housing, the fan housing including a first housing inlet opening towards the cooktop, and a second housing inlet opening in an opposite direction, wherein the fan device is operable to, with the duct being connected to the chamber housing, draw air through the inlet into the chamber, so that some of the air drawn into the chamber is drawn through the first housing inlet into the fan housing, and other of the air drawn into the chamber is drawn through the second housing inlet into the fan housing, and discharge the air in the fan housing through the duct.

10 Claims, 17 Drawing Sheets

(58) Field of Classification Search
USPC ..... 126/299 D
See application file for complete search history.

(56) References Cited

U.S. PATENT DOCUMENTS

| | | | | |
|---|---|---|---|---|
| 11,732,901 | B2 | 8/2023 | Kim et al. | |
| 2006/0150965 | A1 | 7/2006 | Kim et al. | |
| 2013/0340742 | A1 | 12/2013 | Sosso | |
| 2018/0306449 | A1* | 10/2018 | Flesch | F24C 15/2042 |
| 2019/0162421 | A1 | 5/2019 | Cimino et al. | |
| 2021/0095692 | A1* | 4/2021 | Berberoglu | F04D 17/10 |
| 2022/0325900 | A1* | 10/2022 | Srivastava | F24C 15/2071 |
| 2022/0341598 | A1 | 10/2022 | Lee et al. | |
| 2023/0184442 | A1 | 6/2023 | Bruckbauer | |

FOREIGN PATENT DOCUMENTS

| | | | |
|---|---|---|---|
| EP | 3 380 791 | B1 | 10/2019 |
| EP | 3 268 670 | B1 | 11/2019 |
| EP | 3 390 918 | B1 | 3/2020 |
| EP | 3 491 296 | B1 | 3/2020 |
| EP | 3 869 107 | B1 | 2/2022 |
| EP | 3 951 270 | A1 | 2/2022 |
| EP | 4 030 104 | A1 | 7/2022 |
| EP | 4 063 747 | A1 | 9/2022 |
| KR | 10-2006-0087209 | | 8/2006 |
| KR | 10-0747633 | | 8/2007 |
| KR | 3 593 053 | B1 | 11/2020 |
| KR | 3 505 830 | B2 | 3/2021 |
| KR | 10-2021-0090474 | | 7/2021 |
| KR | 10-2022-0147387 | | 11/2022 |
| WO | WO 2017/175085 | A1 | 10/2017 |
| WO | WO 2019/081271 | A1 | 5/2019 |

OTHER PUBLICATIONS

Written Opinion of the International Searching Authority dated Apr. 24, 2024 for International Application No. PCT/KR2023/022000.

* cited by examiner

COOKING APPARATUS

CROSS-REFERENCE TO RELATED APPLICATIONS

This application is a continuation application, under 35 U.S.C. § 111(a), of International Application No. PCT/KR2023/022000, filed on Dec. 29, 2023, which claims priority under 35 U.S.C. § 119 to Korean Patent Application 10-2023-0008915, filed on Jan. 20, 2023, in the Korean Intellectual Property Office, the disclosures of which are incorporated by reference herein in their entireties.

FIELD

The disclosure relates to a cooking apparatus having a cooktop and hood.

DESCRIPTION OF THE RELATED ART

In general, cooking apparatuses are apparatuses for heating and cooking food, and that may provide a number of functions related to cooking, such as heating, defrosting, drying, and sterilizing an object to be cooked. A cooking apparatus may include a cooktop that uses electricity or gas to heat a cooking container containing food.

In the case of cooktops, contaminants such as oil mist, unburned gas, and odor are generated during the process of cooking food. To exhaust or circulate air containing such contaminants to the outside, a hood may be installed. The hood may be formed integrally with the cooktop.

SUMMARY

The disclosure is directed to providing a cooking apparatus with improved fan performance.

Further, the disclosure is directed to providing a cooking apparatus with reduced noise from a fan.

Further, the disclosure is directed to providing a cooking apparatus in which a filter is easy to mount and remove.

Further, the disclosure is directed to providing a cooking apparatus in which a water tray is easy to access.

Technical tasks to be achieved in this document are not limited to the technical tasks mentioned above, and other technical tasks not mentioned will be clearly understood by those skilled in the art from the description below.

According to an embodiment of the disclosure, cooking apparatus includes a cooktop including an inlet: a chamber housing to which a duct is connectable, the chamber housing coupled to the cooktop to form a chamber under the inlet; and a fan device inside the chamber housing, the fan device including a fan, and a fan housing covering the fan, the fan housing including a first housing inlet opening towards the cooktop, and a second housing inlet opening in a direction opposite to a direction in which the first housing inlet opens, wherein the fan device is operable to, with the duct being connected to the chamber housing, draw air through the inlet into the chamber, so that some of the air drawn into the chamber is drawn through the first housing inlet into the fan housing, and other of the air drawn into the chamber is drawn through the second housing inlet into the fan housing, and discharge the air in the fan housing through the duct.

According to an embodiment of the disclosure, the fan housing may be spaced apart from the cooktop so that the some of the air drawn into the chamber is drawn through the first housing inlet.

According to an embodiment of the disclosure, the fan housing may be spaced apart from the chamber housing so that the other of the air drawn into the chamber is drawn through the second housing inlet.

According to an embodiment of the disclosure, the chamber housing may include a side wall coupled to the cooktop, a bottom surface connected to the side wall and disposed to face the inlet, and a support protrusion protruding from the bottom surface towards the cooktop. The fan housing may be seated on the support protrusion to be spaced apart from the bottom surface.

According to an embodiment of the disclosure, the fan housing may be configured to be coupleable to the support protrusion.

According to an embodiment of the disclosure, the chamber housing may include a guide portion configured to guide a seating of the fan housing on the support protrusion.

According to an embodiment of the disclosure, the fan housing may include a housing outlet through which the air in the fan housing is discharged, and a flange surrounding the housing outlet. The chamber housing may include a chamber outlet on the side wall through which air discharged through the housing outlet moves to the duct. The guide portion may include a guide groove adjacent to the chamber outlet, and configured so that the flange is couplable to the guide groove.

According to an embodiment of the disclosure, the fan device may include a fan motor connected to the fan. The fan housing may include a motor cover disposed on the first housing inlet to cover the fan motor.

According to an embodiment of the disclosure, the cooking apparatus may further include a first filter assembly detachably couplable to the inlet, and a second filter assembly may be disposed between the first filter assembly and the fan device when the first filter assembly is detachably coupled to the inlet.

According to an embodiment of the disclosure, the first filter assembly may include a first filter, and a first filter bracket couplable to the inlet. The first filter may be mountable on the first filter bracket so that the air drawn through the inlet into the chamber passes through the first filter. The second filter assembly may include a second filter configured to filter the air that passes through the first filter, and the second filter may be disposed to contact the first filter bracket.

According to an embodiment of the disclosure, the first filter bracket may have a size corresponding to the inlet. The second filter may have a size corresponding to at least a portion of the first filter bracket.

According to an embodiment of the disclosure, the cooking apparatus may further include a water tray disposed inside the chamber housing. The water tray may be movable through the inlet.

According to an embodiment of the disclosure, the water tray may include a tray plate having an opening at an upper portion to store water, and a tray cover covering at least a portion of the upper portion so as to accommodate water when the tray plate is tilted.

According to an embodiment of the disclosure, the tray plate and the tray cover may be integrally formed.

An embodiment of the disclosure provides a cooking apparatus including a top plate on which a cookware is placed, the cooktop including an inlet formed to penetrate the top plate in one direction so as to drawn in air around the top plate, a chamber housing coupled to the cooktop to form a chamber into which air flows through the inlet, a duct guiding the air discharged from the chamber housing, a fan disposed inside the chamber housing to draw in air through the inlet and discharge the drawn-in air into the duct. The fan includes a first intake portion and a second intake portion disposed along the one direction. The cooking apparatus includes a first flow path formed inside the chamber housing and provided to allow air flowing into the inlet to travel to a first intake portion of the fan, and a second flow path provided so that the air flowing into the inlet travels to a second intake portion of the fan and partitioned from the first flow path by the fan.

An embodiment of the disclosure provides a cooking apparatus including a cooktop with an inlet, a chamber housing coupled to the cooktop to form a chamber into which air flows in through the inlet, a duct guiding the air discharged from the chamber housing, a fan disposed inside the chamber housing to draw in air through the inlet and discharge the drawn-in air into the duct, a fan housing including a first housing inlet opening towards the cooktop and a second housing inlet opening in a direction opposite to a direction in which the first housing inlet opens, a first filter assembly detachably coupled to the inlet, and a second filter assembly disposed between the first filter assembly and the fan housing and in contact with the first filter assembly.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
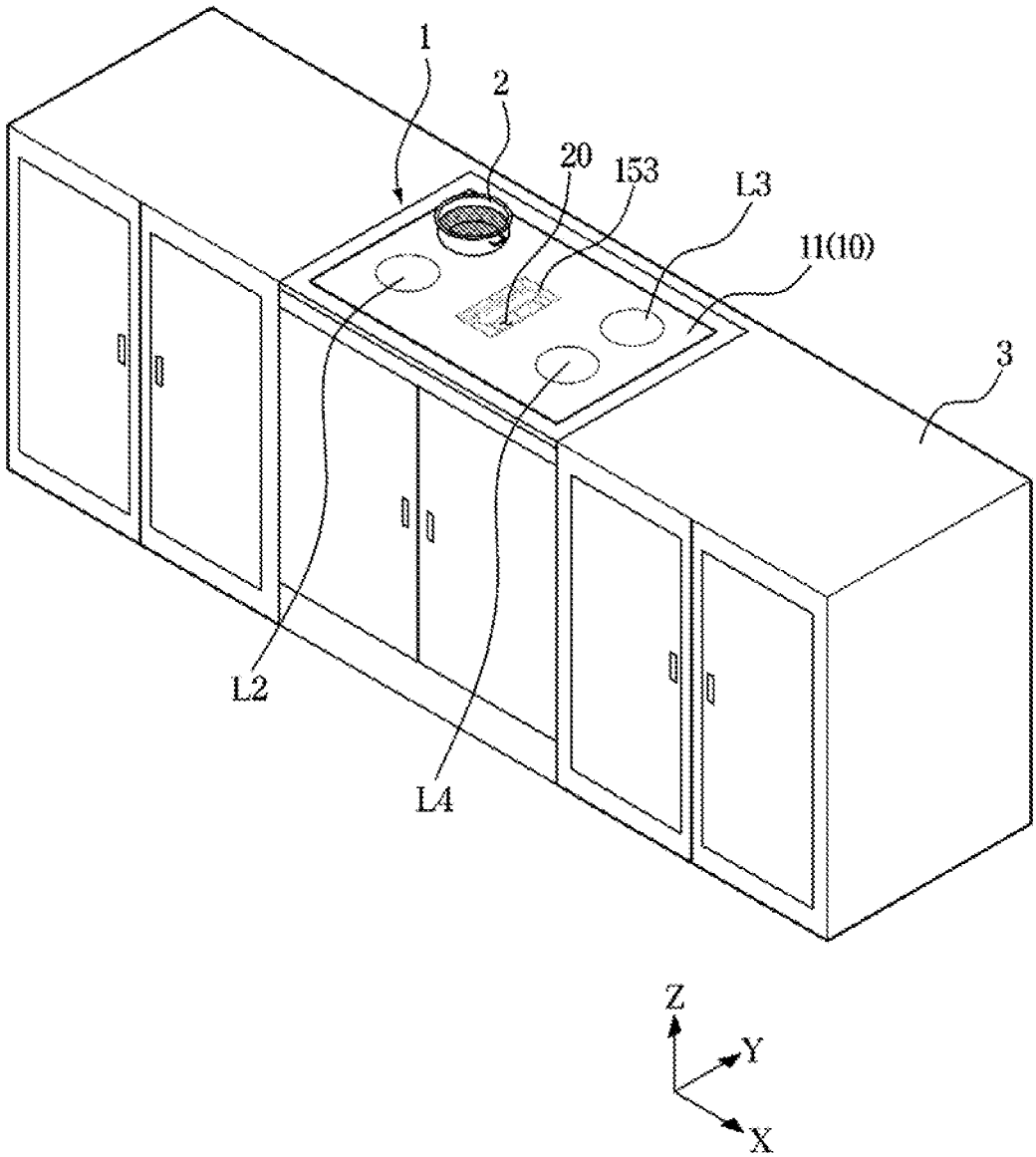
FIG. 1 is a perspective view showing a cooking apparatus installed according to an embodiment of the present disclosure.

Embodiments described in the disclosure and configurations shown in the drawings are merely examples of the embodiments of the disclosure and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, figures, steps, operations, elements, components, or combinations thereof, but do not preclude the presence or addition of one or more of the features, figures, steps, operations, elements, components, or combinations thereof.

It will be understood that, although the terms first, second, primary, secondary, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

However, the terms "front", "rear", "left", "right", and the like used in the following description are defined based on the drawings, and the shape and location of each component may not be limited by these terms.

Figure 2:
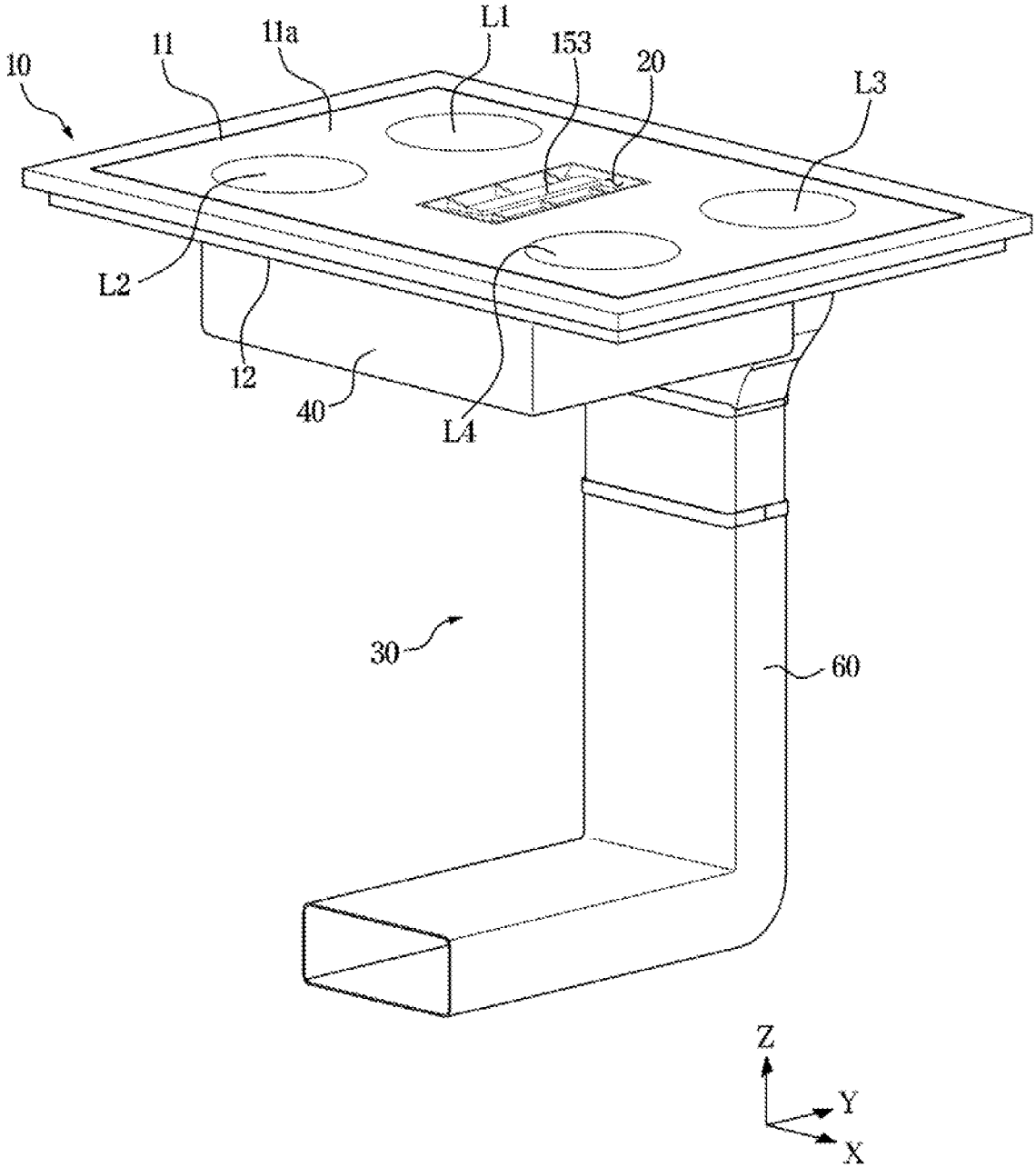
FIG. 2 is a perspective view showing the cooking apparatus according to an embodiment of the present disclosure.

For convenience, the illustrated orientation of a cooktop 10 relative to a hood 30 in a cooking apparatus 1 is defined as "upper portion", as shown in FIG. 2.

Hereinafter, an embodiment according to the disclosure will be described in detail with reference to the accompanying drawings.

FIG. 1 is a perspective view showing a cooking apparatus installed according to an embodiment of the present disclosure. FIG. 2 is a perspective view showing the cooking apparatus according to an embodiment of the present disclosure.

The cooking apparatus 1 may be disposed in an indoor location. For example, the cooking apparatus 1 may be placed in a kitchen and may be coupled to and installed in a storage cabinet 3.

The cooking apparatus 1 may be adapted to cook food. The cooking apparatus 1 may include the cooktop 10 designed to cook food and the hood 30 designed to intake air containing contaminants generated in a process of cooking food. The cooking apparatus 1 may be a hood-integrated cooktop in which the hood 30 is arranged on a lower portion of the cooktop 10.

The cooktop 10 may be an induction, which is an electric cooktop. The cooktop 10 may include a plurality of coils (not shown) corresponding to positions L1, L2, L3, and L4 on which cooking vessel may be placed. A current may be applied to the coils that varies in magnitude over time. As current is applied to the coil, a magnetic field may be formed around the coils. As the current applied to the coil varies, the magnetic field formed around the coils may also vary. An eddy current may flow due to a change in the magnetic field on a surface of a cookware 2 in contact with an upper plate 11, thereby heating the cooking vessel.

In the present drawings, the cooktop 10 is shown to be an induction, which is an electric cooktop, but the present disclosure is not limited thereto. There may be no limitation on the type of cooktop 10. For example, the cooktop 10 may be a highlight among electric cooktops.

For example, induction uses a magnetic field to cause current to flow, which may reduce the risk of burns because induction heats a cooking vessel directly without heating the upper plate. However, only metal containers with magnets can be used as cooking vessels, and glass, ceramic, or aluminum cannot be used. Highlighting works by passing electricity through the nichrome wires underneath a ceramic plate and using the heat generated to heat the upper plate and the cooking vessel, which may increase the risk of burns from the heated upper plate. However, any cookware with a flat bottom may be used, excluding cookware for open flame cooking. The cooktop 10 may also be a hybrid that may use both induction and highlighting. A hybrid may be a product that has the advantages of both induction and highlighting.

The cooktop 10 may be a gas cooktop in addition to an electric cooktop. For example, the cooktop 10 may be a gas range. However, in the present drawings, an induction, which is an electric cooktop, will be described as an example.

The hood 30 may be designed to discharge air containing contaminants generated from the cooktop 10 to the outside. Alternatively, the hood 30 may be arranged to filter the air containing contaminants and circulate the filtered air back into the interior.

The cooking apparatus 1 may be a hood-integrated cooktop that combines the cooktop 10 and the hood 30. The hood 30 may be coupled to a lower portion of the cooktop 10. However, the present disclosure is not limited thereto, and the cooktop 10 and the hood 30 may be formed integrally.

The hood 30 may be disposed on the lower portion of the cooktop 10, thereby securing space above where the cooking apparatus 1 is installed. In addition, the hood 30 may disposed at a rear side of the cooktop 10, thereby securing a front space. For example, referring to FIG. 1, an upper portion of the cooking apparatus 1 is an empty space, which may improve aesthetics, and a storage space of the storage cabinet 3 may be provided in front of the cooking apparatus 1 to improve convenience.

In other words, the cooking apparatus 1 may be a hood-integrated cooktop, thereby improving space utilization.

Figure 3:
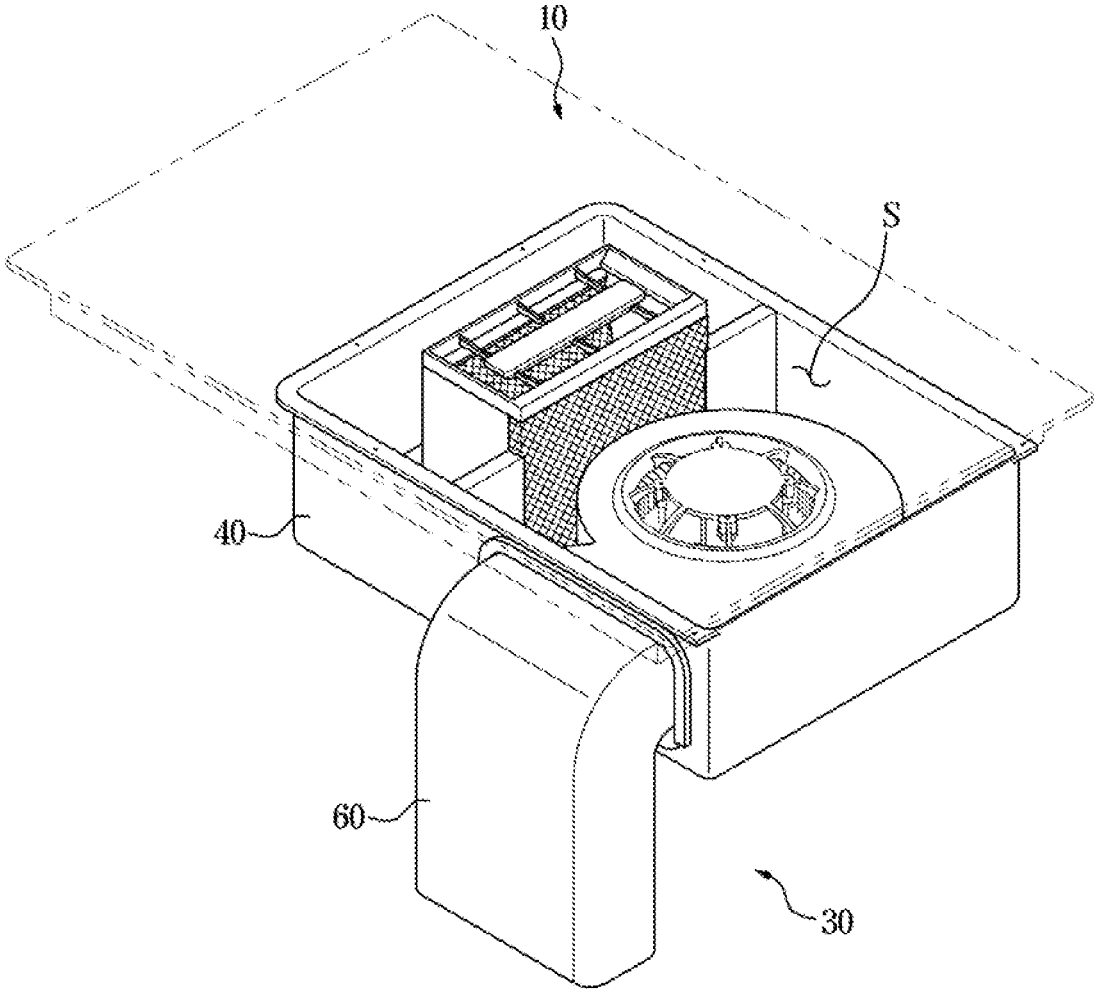
FIG. 3 is a perspective view showing a hood of the cooking apparatus according to an embodiment of the present disclosure.
Figure 4:
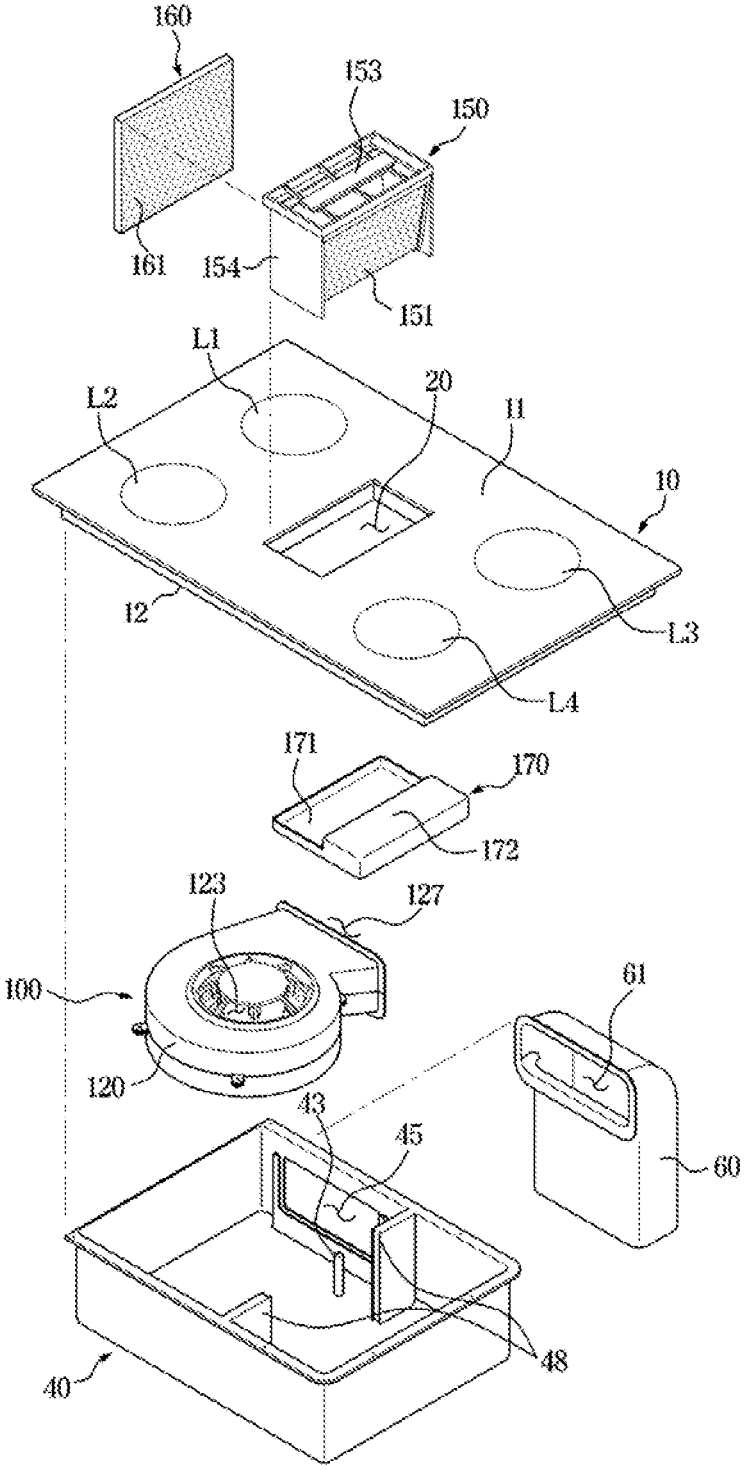
FIG. 4 is an exploded perspective view of a configuration of the cooking apparatus according to an embodiment of the present disclosure.
Figure 5:
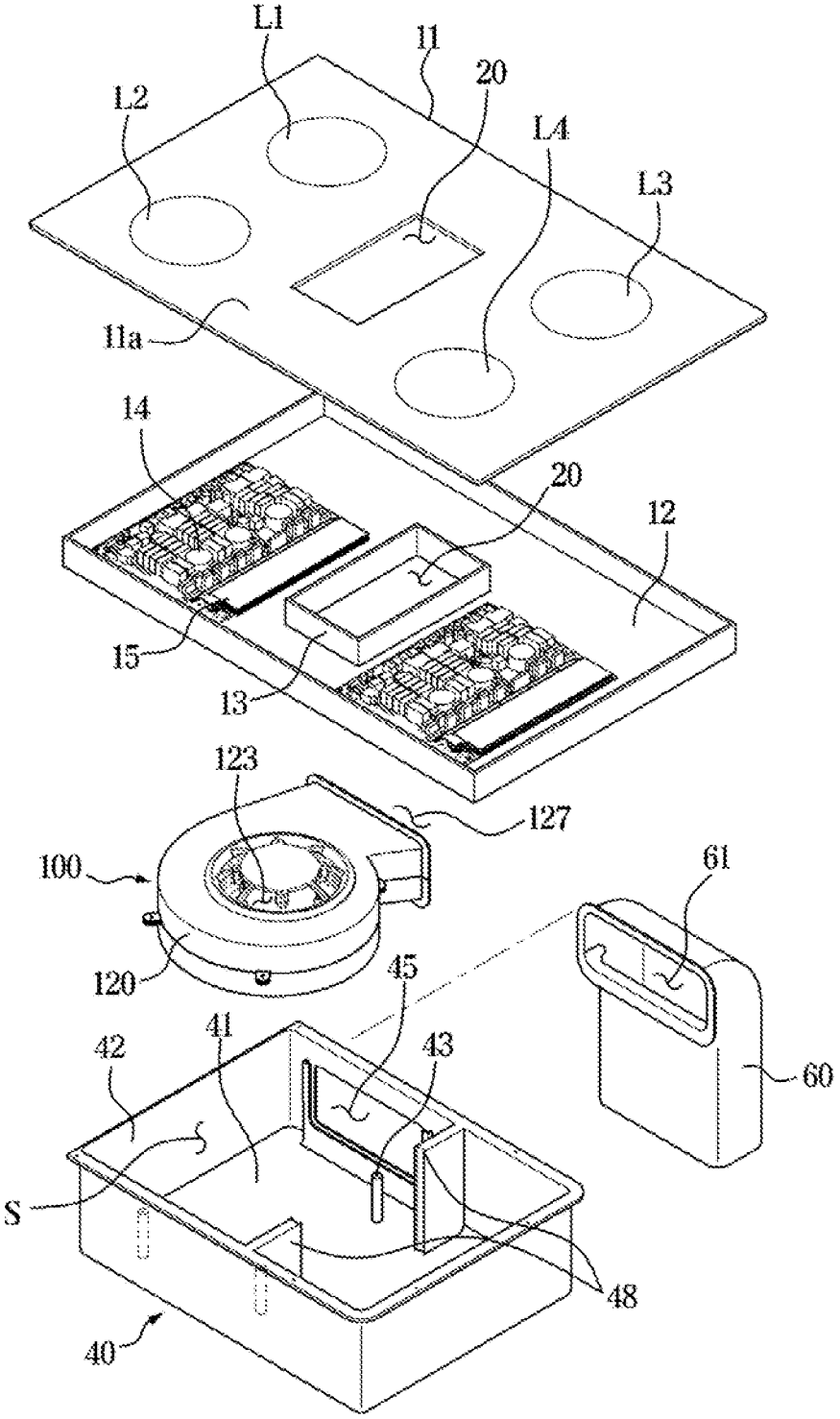
FIG. 5 is an exploded perspective view of the configuration of the cooking apparatus according to an embodiment of the present disclosure.

FIG. 3 is a perspective view showing the hood of the cooking apparatus according to an embodiment of the present disclosure. FIG. 4 is an exploded perspective view of a configuration of the cooking apparatus according to an embodiment of the present disclosure. FIG. 5 is an exploded perspective view of the configuration of the cooking apparatus according to an embodiment of the present disclosure.

The hood 30 may be placed on the lower portion of the cooktop 10. The hood 30 may include a chamber housing 40 and a duct 60.

The duct 60 may be provided such that air introduced through an inlet 20 is discharged to the outside of the hood 30. Alternatively, the duct 60 may be provided such that the air introduced through the inlet 20 is filtered and then circulated back into the interior.

The chamber housing 40 may be arranged to connect the cooktop 10 and the duct 60. The chamber housing 40 may be provided so that the air introduced through the inlet 20 travels to the duct 60. The chamber housing 40 may be provided to form a chamber S in which air flows.

The chamber housing 40 may include a flow path in which air flows. The chamber housing 40 may function as a portion of a duct.

The chamber S may be formed inside the chamber housing 40. The chamber S may refer to an internal space. The chamber S may be provided to accommodate various components.

The chamber S may be a passage through which air entering the inlet 20 is discharged into the duct 60. The chamber S may be a flow path disposed between the inlet 20 and a housing outlet 127.

The chamber S may be a space configured for air to travel from the inlet 20 to the housing outlet 127. The chamber S may be a space formed by the inlet 20 and the housing outlet 127.

The air drawn into the inlet 20 of the cooktop 10 may pass through a first filter assembly 150 and a second filter assembly 160, pass through a fan device 100, and be discharged into the duct 60.

Specifically, the air may pass through an intake grill 153 and be filtered by a first filter 151. After being filtered through a second filter 161, the air may flow into the fan device 100 through a first housing inlet 124 and a second housing inlet 126. The air may then be discharged to the outside of the fan device 100 through the chamber housing outlet 127 and travel to the duct 60.

Referring to FIG. 5, the cooktop 10 may include the upper plate 11 on which the cookware 2 is placed and a lower plate 12 disposed on a lower portion of the upper plate 11. The cookware 2 may be placed on an upper surface 11*a* of the upper plate 11. The cookware 2 may be placed at different positions L1, L2, L3, and L4 on the upper plate 11.

The upper plate 11 may have a substantially square shape. However, the present disclosure is not limited thereto, and the upper plate 11 may be provided in other shapes.

The lower plate 12 may be combined with the upper plate 11 to accommodate internal components. The lower plate 12 may include an accommodating space. Electrical components 14, heat sinks 15, and the like may be provided in the accommodating space. When the cooktop 10 is in operation, the electrical components 14 generate heat, which may be dissipated by the heat sinks 15.

The lower plate 12 may have a substantially square shape. However, the present disclosure is not limited thereto, and the lower plate 12 may be provided in other shapes.

The cooktop 10 may include the inlet 20. The inlet 20 may be arranged to draw in air around the cooktop 10. The inlet 20 may communicate with the chamber housing 40. Air may enter the hood 30 through the inlet 20.

The inlet 20 may be formed to penetrate the cooktop 10. The inlet 20 may be formed in the upper plate 11 and/or the lower plate 12. The inlet 20 may be formed in the upper plate 11 and the corresponding lower plate 12, so that air may flow into the hood 30 through the upper plate 11 and lower plate 12 of the cooktop 10. The inlet 20 may be formed by penetrating from the upper surface 11*a* of the upper plate 11 to a lower surface 12*b* of the lower plate 12.

The inlet 20 may be formed to penetrate the cooktop 10 in one direction. One direction may be a vertical direction in which the upper plate 11 and the lower plate 12 are disposed.

The lower plate 12 may include a protruding portion 13 provided around the inlet 20. The protruding portion 13 may be disposed to protrude from the lower plate 12 toward the upper plate 11 along a circumference of the inlet 20. The protruding portion 13 may protrude upwardly.

The protruding portion 13 may include a plate. The protruding portion 13 may be in contact with a lower surface of the upper plate 11. The protruding portion 13 may guide the air introduced through the inlet 20 of the upper plate 11 to travel to the inlet 20 of the lower plate 12. Air may be drawn into the chamber S by the protruding portion 13 without loss of flow.

The inlet 20 may be formed approximately at a center of the cooktop 10 to draw in air uniformly around the top plate 11. For example, the inlet 20 may be formed to uniformly draw in air regardless of the position of the cookware 2 placed at any one of a first position L1, a second position L2, a third position L3, and a fourth position L4.

The inlet 20 may have a substantially rectangular shape. However, the present disclosure is not limited thereto, and the inlet 20 may be formed in different shapes, such as circular.

The hood 30 may include the chamber housing 40 and the duct 60.

The chamber housing 40 may have an open top. The chamber housing 40 may include an opening provided toward the cooktop 10. The opening may be provided on an upper portion of the chamber housing 40.

The opening of the chamber housing 40 may be formed to be larger than the inlet 20 of the cooktop 10. A portion of the opening of the chamber housing may correspond to the inlet 20, and the remaining portion thereof may be covered by the lower surface 12*b* of the lower plate 12. Accordingly, the air that has passed through the inlet 20 may be drawn into the chamber S through the portion of the opening of the chamber housing 40 corresponding to the inlet 20.

The chamber housing 40 may include a chamber outlet 45. The chamber outlet 45 may be formed on one side of the chamber housing 40.

The chamber outlet 45 may discharge air introduced into the chamber S into the duct 60. The chamber outlet 45 may be connected to a duct inlet 61. The chamber outlet 45 may be formed to correspond to the duct inlet 61.

The chamber outlet 45 may be provided such that the air discharged through the housing outlet 127 passes to the duct 60. The chamber outlet 45 may be connected to the housing outlet 127.

The chamber outlet 45 may correspond to the housing outlet 127. The chamber outlet 45 may be provided at a position corresponding to the housing outlet 127. The chamber outlet 45 may be provided in the same size and/or shape as the housing outlet 127.

The chamber outlet 45 may be formed in a substantially rectangular shape. The chamber outlet 45 may extend along a left-right direction.

The fan device 100 may be disposed between the cooktop 10 and the chamber housing 40. The fan device 100 may be disposed inside the chamber S. The fan device 100 may be arranged to be spaced apart from the lower plate 12 of the cooktop 10. The fan device 100 may be spaced apart from a bottom surface 41 of the chamber housing 40.

Figure 6:
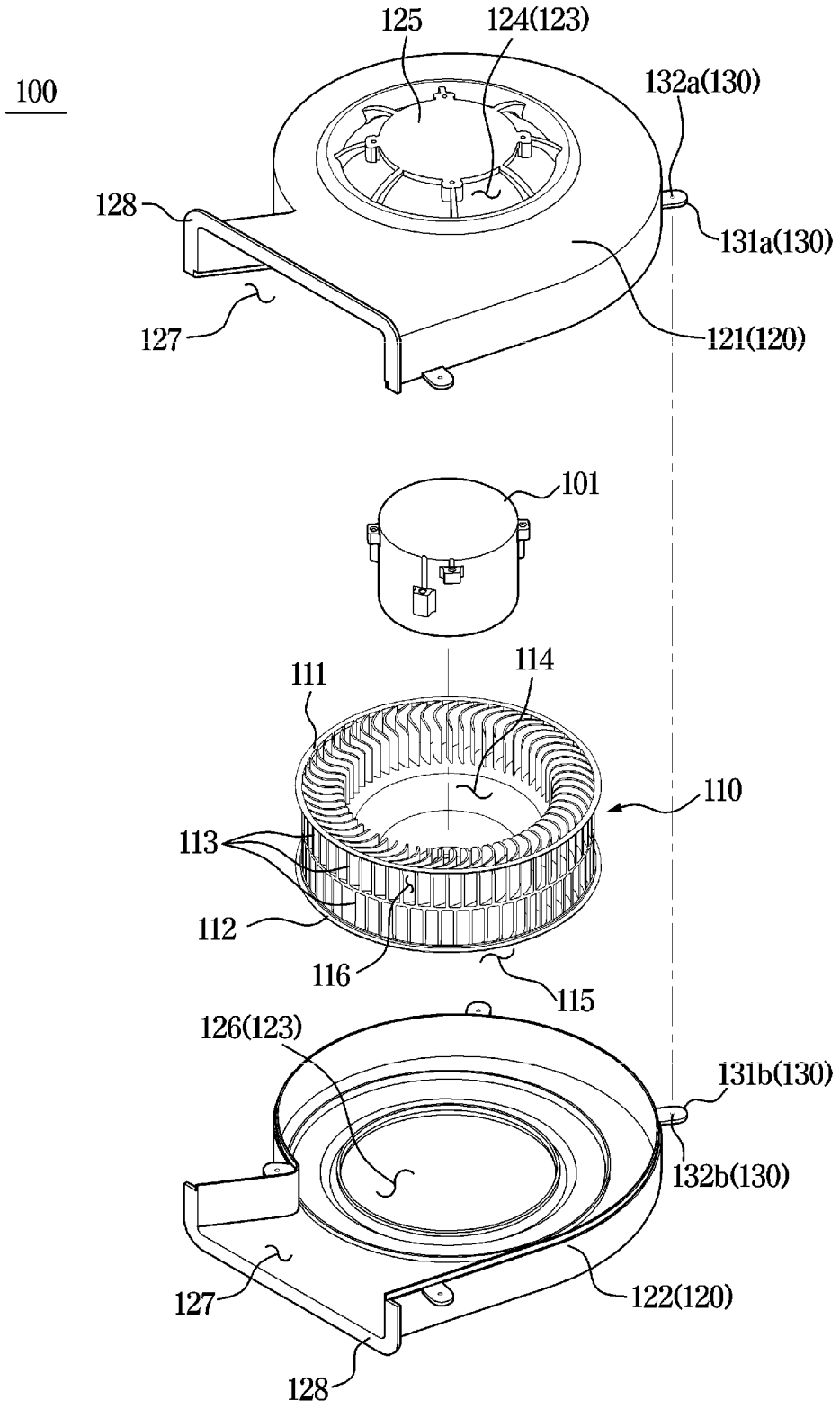
FIG. 6 is an exploded perspective view of a configuration of a fan device according to an embodiment of the present disclosure.

FIG. 6 is an exploded perspective view of a configuration of the fan device according to an embodiment of the present disclosure.

The fan device 100 may include a fan motor 101, a fan 110 coupled to the fan motor 101, and a fan housing 120 provided to cover the fan 110.

The fan motor 101 may be provided to be rotatable. The fan motor 101 may be connected to the fan 110. The fan motor 101 may provide a rotational force to the fan 110. The fan motor 101 may be placed inside the fan housing 120.

The fan 110 may rotate about a rotation shaft by the fan motor 101. The fan 110 may be provided to flow air. The fan 110 may generate a drawing force to cause air to flow in through the inlet 20.

The fan 110 may include a first intake portion 114 and a second intake portion 115. The fan 110 may include a first ring 111 and a second ring 112. The second ring 112 may be spaced apart from the first ring 111. The first intake portion 114 may be disposed adjacent to the first ring 111, and the second intake portion 115 may be disposed adjacent to the second ring 112.

The first intake portion 114 and the second intake portion 115 may be arranged to face each other. The first intake portion 114 and the second intake portion 115 may be arranged along one direction.

A plurality of blades 113 may be disposed between the first ring 111 and the second ring 112. A discharge portion 116 may be formed between the plurality of blades 113. The discharge portion 116 may be provided to discharge air drawn into the first intake portion 114 and/or the second intake portion 115. The discharge portion 116 may be formed in a direction perpendicular to a rotation axis. The fan 110 may be a double intake blower. The fan 110 may be a sirocco fan.

The fan housing 120 may be provided to cover the fan 110. The fan housing 120 may include a housing inlet 123 through which air is drawn into the fan housing 120 and the housing outlet 127 through which air is discharged to the outside of the fan housing 120.

The housing inlet 123 may include the first housing inlet 124 and the second housing inlet 126. The first housing inlet 124 may be spaced apart from the second housing inlet 126.

The first housing inlet 124 and the second housing inlet 126 may be arranged to face each other. The first housing inlet 124 and the second housing inlet 126 may be arranged along one direction.

The first housing inlet 124 may be open towards the cooktop 10. The second housing inlet 126 may be open towards face a direction opposite to a direction in which the first housing inlet 124 is open.

The first housing inlet 124 may be provided to correspond to the first intake portion 114 of the fan 110, and the second housing inlet 126 may be provided to correspond to the second intake portion 115 of the fan 110.

The first housing inlet 124 may be provided to allow air to be drawn into the first intake portion 114 of the fan 110. The first housing inlet 124 may be disposed adjacent to the first intake portion 114 of the fan 110.

The second housing inlet 126 may be provided to allow air to be drawn into the second intake portion 115 of the fan 110. The second housing inlet 126 may be disposed adjacent to the second intake portion 115 of the fan 110.

The fan housing 120 may include a first fan housing 121 and a second fan housing 122 that may be coupled thereto. The first housing inlet 124 may be formed in the first fan housing 121. The second housing inlet 126 may be formed in the second fan housing 122.

A housing coupling portion 130 may be provided in the first fan housing 121 and/or the second fan housing 122. The first fan housing 121 and the second fan housing 122 may be coupled to each other by the housing coupling portion 130.

The housing coupling portion 130 may include a protrusion plate 131. A plurality of protrusion plates 131 may be provided. The first fan housing 121 may include a first protrusion plate 131*a*, and the second fan housing 122 may include a second protrusion plate 131*b*. In the present drawings, each of the first fan housing 121 and the second fan housing 122 is shown as an example, including four protrusion plates 131*a* and 131*b*, but the present disclosure is not limited thereto.

The protrusion plates 131 each may include a through-hole 132. The through-hole 132 may be provided in each of the plurality of protrusion plates 131. The through-hole 132 may be provided so that a fastening member penetrates.

The first fan housing 121 may include a first through-hole 132*a*, and the second fan housing 122 may include a second through-hole 132*b*.

The first protrusion plate 131*a* of the first fan housing 121 and the second protrusion plate 131*b* of the second fan housing 122 may be provided at positions corresponding to each other. With the first protrusion plate 131*a* and the second protrusion plate 131*b* in contact, the first fan housing 121 and the second fan housing 122 may be combined by inserting the fastening member into the first through-hole 132*a* and the second through-hole 132*b*.

However, the present disclosure is not limited thereto, and the first fan housing 121 and the second fan housing 122 may be formed integrally.

The fan motor 101 may be disposed inside the fan housing 120. The fan motor 101 may be disposed between the first fan housing 121 and the fan 110.

The first fan housing 121 may include a motor cover 125. The motor cover 125 may be provided to cover the fan motor 101. The motor cover 125 may be located at the first housing inlet 124. The motor cover 125 may prevent the fan motor 101 from being exposed by the first housing inlet 124.

The fan housing 120 may include the housing outlet 127. The housing outlet 127 may be open in a direction perpendicular to the direction in which the housing inlet 123 is open.

The fan housing 120 may include a flange 128 disposed adjacent to the housing outlet 127. The flange 128 may be provided to surround the housing outlet 127. The flange 128 may have a plate shape protruding outwardly from the housing outlet 127.

The fan device 100 may be assembled into the chamber housing 40 as a unit. In other words, the fan device 100 may be coupled to the chamber housing 40 in a state in which the fan 110 and the fan motor 101 are mounted on the fan housing 120. Accordingly, compared to assembling the fan 110 and/or the fan motor 101 to the cooking apparatus 1, respectively, deviations in performance due to design tolerances may be reduced.

Furthermore, since the fan device 100 may be provided in the form of an integrated assembly, convenience in mounting the fan device 100 to the chamber housing 40 may be improved. Furthermore, compatibility between the fan device 100 and the cooking apparatus 1 on which the fan device 100 is mounted may be improved.

Figure 7:
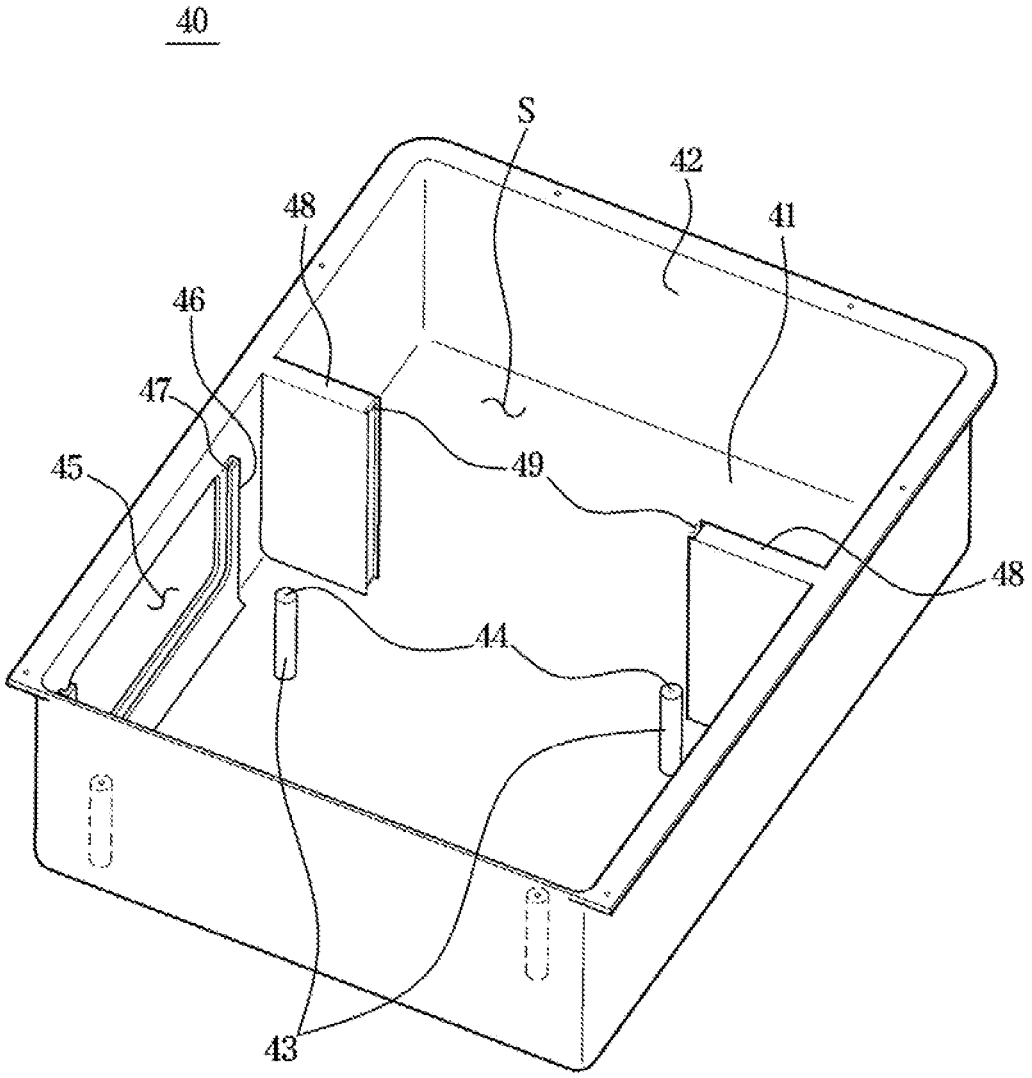
FIG. 7 is a perspective view showing a chamber housing according to an embodiment of the present disclosure.

FIG. 7 is a perspective view showing the chamber housing according to an embodiment of the present disclosure.

The chamber housing 40 may form the chamber S. The chamber S may be disposed to accommodate various components. The chamber S may be a space formed by the bottom surface 41 and a side wall 42.

The chamber housing 40 may include the bottom surface 41. The bottom surface 41 may have a plate shape. The bottom surface 41 may be arranged to face the cooktop 10. The bottom surface 41 may be arranged to face the inlet 20 of the cooktop 10.

The chamber housing 40 may include the side wall 42 extending from the bottom surface 41. The side wall 42 may extend towards the cooktop 10. The side wall 42 may be provided to be in contact with the lower plate 12 of the cooktop 10.

The chamber housing 40 may include support protrusions 43. The support protrusions 43 may be provided to support the fan device 100. The support protrusions 43 may be provided such that the fan device 100 is spaced apart from the chamber housing 40.

The support protrusion 43 each may be provided to contact the fan housing 120. The support protrusion 43 may be provided to allow the fan housing 120 to be seated thereon. The support protrusion 43 may be provided to be coupled to the housing coupling portion 130. The support protrusion 43 may be provided so that the fan device 100 may be assembled to the chamber housing 40.

Each support protrusion 43 may be provided at a position corresponding to the first protrusion plate 131*a* and/or the second protrusion plate 131*b*. The support protrusions 43 may be provided in a plurality. The support protrusions 43 may be provided to correspond to the number of the plurality of protrusion plates 131.

Each of the support protrusions 43 may be formed on the bottom surface 41. The support protrusion 43 may protrude from the bottom surface 41 towards the cooktop 10. The support protrusion 43 may protrude from the bottom surface 41 towards a direction in which the side wall 42 extends.

Each of the support protrusions 43 may include an insertion hole 44. The insertion holes 44 each may be provided at a position corresponding to the first through-hole 132*a* and/or the second through-hole 132*b*.

The fastening member may fasten the fan housing 120 to the support protrusion 43 by being inserted into the first through-hole 132*a*, the second through-hole 132*b*, and the insertion hole 44.

The chamber housing 40 may include the chamber outlet 45. The chamber outlet 45 may be arranged on at a position corresponding to the housing outlet 127 of the fan housing 120.

The chamber housing 40 may include a guide portion 46 provided to guide a position at which the fan housing 120 is seated on the support protrusions 43. The guide portion 46 may guide the position at which the fan device 100 in the chamber housing 40 is placed. The guide portion 46 may guide the fan housing 120 to be coupled to the support protrusions 43.

The guide portion 46 may be disposed adjacent to the chamber outlet 45. The guide portion 46 may be arranged to surround at least a portion of the chamber outlet 45.

The guide portion 46 may include a guide groove 47. The guide groove 47 may be provided so that the flange 128 of the fan housing 120 may be coupled thereto. The guide groove 47 may be provided such that the flange 128 is slidably coupled thereto.

When assembling the fan device 100 to the chamber housing 40, the flange 128 of the fan housing 120 may be coupled to the guide groove 47. Specifically, the flange 128 may be coupled to the guide groove 47 in a vertical direction. At this time, the housing coupling portion 130 and the support protrusion 43 may come into contact with each other. Thereafter, the fan device 100 may be coupled to the chamber housing 40 by fastening the fastening member to the first through-hole 132*a*, the second through-hole 132*b*, and the insertion hole 44.

Figure 8:
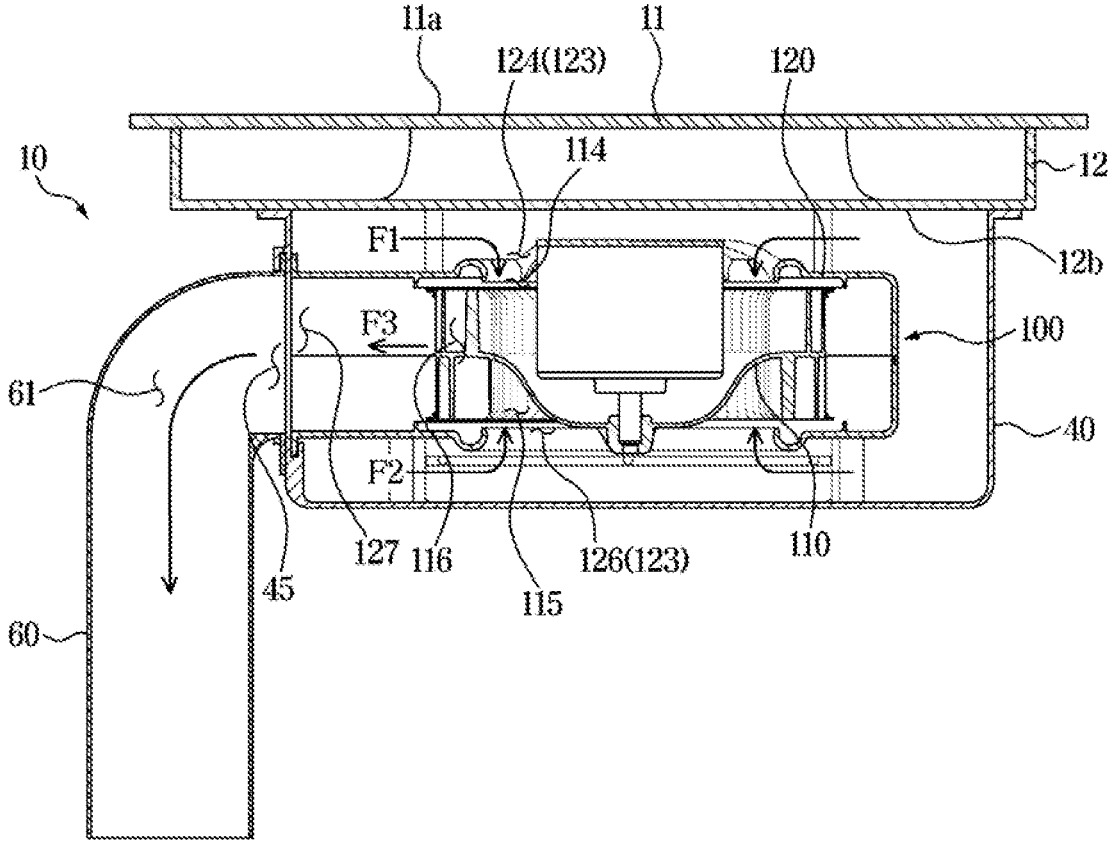
FIG. 8 is a cross-sectional view showing a flow of air of the cooking apparatus according to an embodiment of the present disclosure.

FIG. 8 is a cross-sectional view showing a flow of air of the cooking apparatus according to an embodiment of the present disclosure.

The fan device 100 may be coupled to the chamber housing 40 by the support protrusions 43 and arranged inside the chamber S.

The fan device 100 may be arranged to be spaced apart from the cooktop 10. The fan housing 120 may be spaced apart from the lower plate 12 of the cooktop 10. A first flow path F1 may be formed between the lower plate 12 and the first fan housing 121. Air drawn into the inlet 20 may travel along the first flow path F1 to the first housing inlet 124. Thereafter, the air may be drawn into the first intake portion 114 of the fan 110 and discharged through the discharge portion 116 of the fan 110.

The fan device 100 may be spaced apart from the chamber housing 40. The fan housing 120 may be spaced apart from the bottom surface 41 of the chamber housing 40. A second flow path F2 may be formed between the bottom surface 41 and the second fan housing 122. Air drawn into the inlet 20 may travel along the second flow path F2 to the second housing inlet 126. Thereafter, the air may be drawn into the second intake portion 115 of the fan 110 and discharged into the discharge portion 116 of the fan 110.

The first flow path F1 and the second flow path F2 may be formed inside the chamber housing 40. The first flow path F1 and the second flow path F2 may be provided in the chamber S. The second flow path F2 may be a flow path that is distinct from the first flow path F1.

The first flow path F1 and the second flow path F2 may be partitioned by the fan housing 120. The first flow path F1 may be formed between the cooktop 10 and the fan housing 120, and the second flow path F2 may be formed between the fan housing 120 and the chamber housing 40.

The air drawn into the inlet 20 may be drawn into the fan device 100 through the first flow path F1 and/or the second flow path F2, thereby improving air flow performance. The fan device 100 may intake air through the first inlet 20 and/or the second inlet 20, thereby improving air volume performance and reducing noise.

The first flow path F1 and the second flow path F2 may be arranged along one direction.

The air drawn into the fan 110 through the first flow path F1 and/or the second flow path F2 may be discharged from the fan 110 through a third flow path F3 and travel to the duct 60. The third flow path F3 may be a flow path in which air that has passed through the first flow path F1 and the second flow path F2 is joined and moves to the duct 60.

Figure 9:
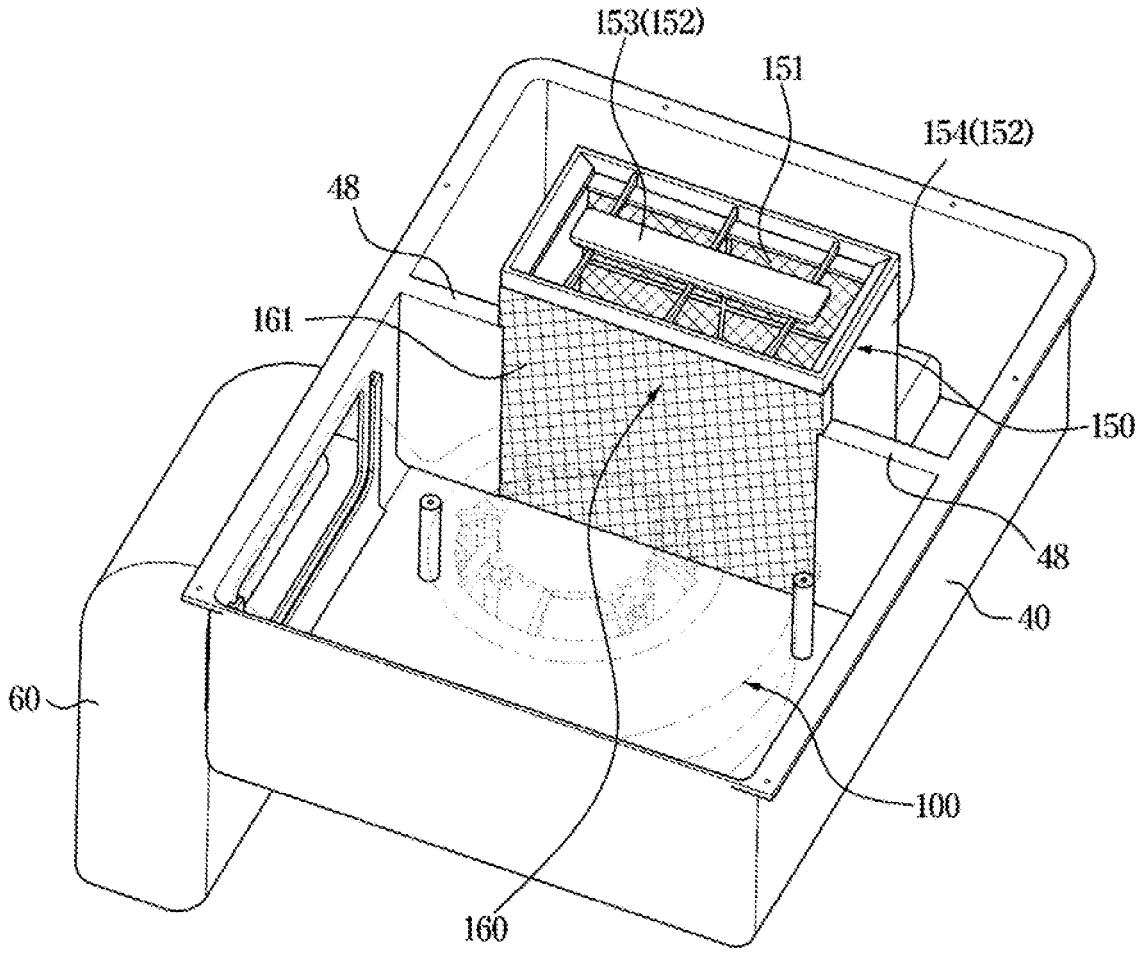
FIG. 9 is a perspective view showing a filter arrangement of the cooking apparatus according to an embodiment of the present disclosure.
Figure 10:
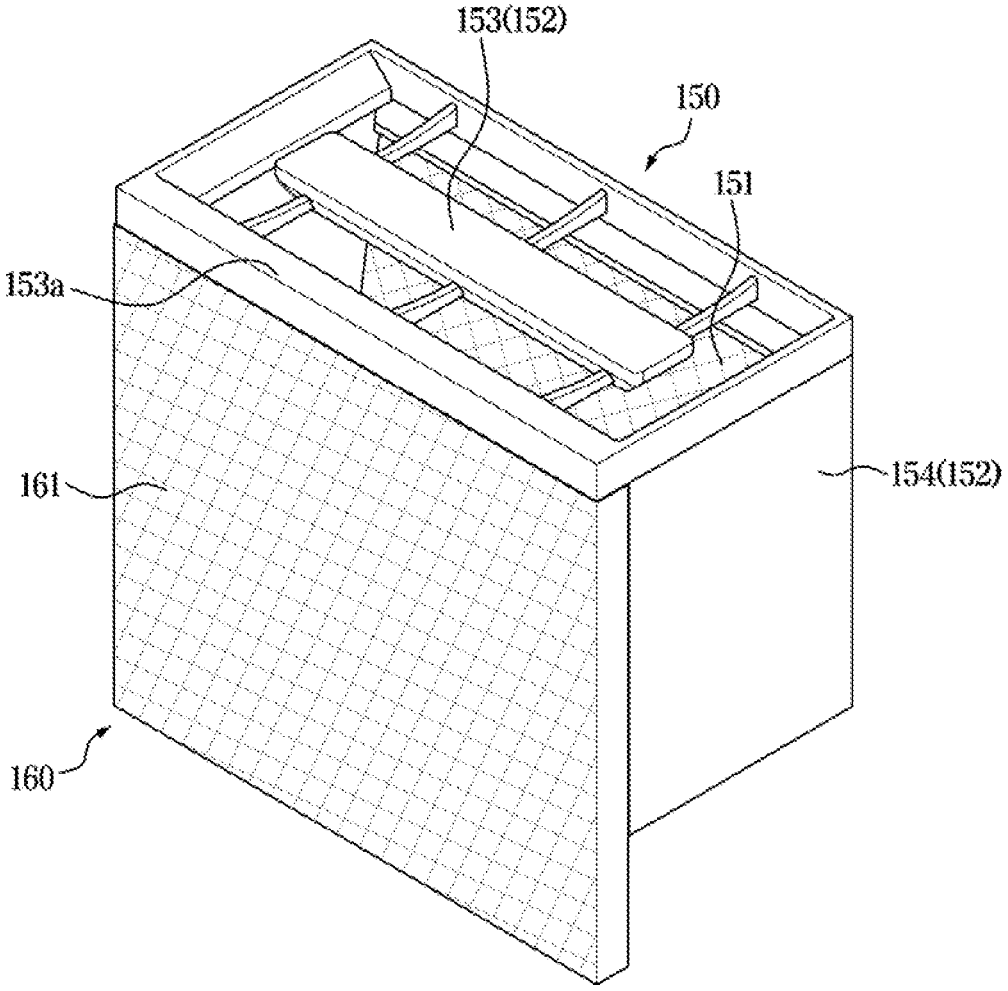
FIG. 10 is a perspective view showing a coupled filter according to an embodiment of the present disclosure.
Figure 11:
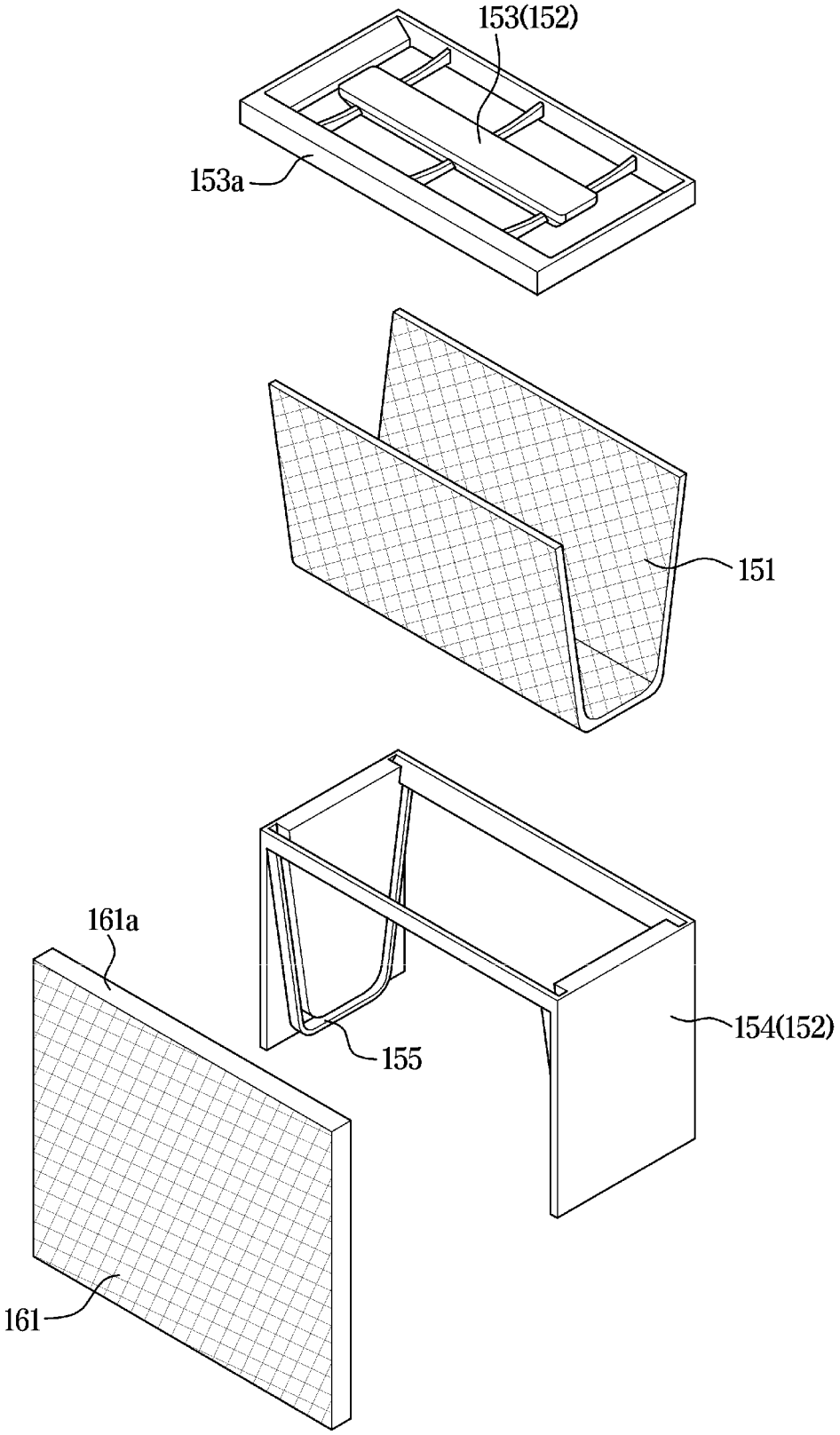
FIG. 11 is an exploded perspective view of a configuration of the filter according to an embodiment of the present disclosure.

FIG. 9 is a perspective view showing a filter arrangement of the cooking apparatus according to an embodiment of the present disclosure. FIG. 10 is a perspective view showing the combined filter according to an embodiment of the present disclosure. FIG. 11 is an exploded perspective view of the configuration of the filter according to an embodiment of the present disclosure.

The cooking apparatus 1 may include the first filter assembly 150 and the second filter assembly 160. The second filter assembly 160 may be provided to filter air that has passed through the first filter assembly 150. The second filter assembly 160 may be disposed on a downstream side of the first filter assembly 150.

The first filter assembly 150 may cover between the inlet 20 and the chamber S to filter out contaminants drawn into the inlet 20.

The first filter assembly 150 may include the first filter 151 and a filter bracket 152 on which the first filter 151 is mounted.

The first filter 151 may be a grease filter to remove oil stains. The first filter 151 may have a substantially U-shaped cross-section. The first filter 151 may have fine holes to allow air, except for oil, to pass through.

The filter bracket 152 may be provided to mount the first filter 151 to the inlet 20. The filter bracket 152 may be provided such that the first filter 151 is mounted thereto. The filter bracket 152 may be coupled with the first filter 151.

The filter bracket 152 may be mounted on the inlet 20. The filter bracket 152 may be detachably coupled to the inlet 20. The filter bracket 152 may be provided to surround an upper side of the first filter 151.

The filter bracket 152 may include the intake grill 153 provided to cover the inlet 20, and a filter frame 154 coupled to the intake grill 153. However, the present disclosure is not limited thereto, and the filter bracket 152 may be formed integrally.

The intake grill 153 may be provided to prevent foreign substances from entering the inlet 20. The intake grill 25 may be mounted on the top plate 11 to cover the inlet 20.

The filter frame 154 may be placed on a lower portion of the intake grill 153. The filter frame 154 may be provided to support the intake grill 153.

The filter frame 154 may include a frame hole 155 to which the first filter 151 is coupled. The frame hole 155 may be provided to correspond to the shape of the first filter 151. The first filter 151 may be coupled to and fixed to the frame hole 155.

The second filter assembly 160 may include the second filter 161. The second filter 161 may be provided to filter air that has passed through the first filter 151. The second filter 161 may be disposed on a downstream side of the first filter 151.

The second filter 161 may be formed of a different material from the first filter 151. The second filter 161 may be a deodorizing filter. The second filter 161 may be provided to filter out fine particles or remove odors from the air that has passed through the first filter 151. However, the present disclosure is not limited thereto, and the second filter 161 may be provided as a filter with a number of functions.

The second filter 161 may have a substantially rectangular shape.

Referring to FIG. 9, the second filter 161 may be placed inside the chamber housing 40. The chamber housing 40 may include a filter support wall 48. The second filter 161 may be supported by the filter support wall 48.

The filter support wall 48 may extend from the side wall 42 and/or the bottom surface 41 of the chamber housing 40. The filter support wall 48 may be provided to secure the second filter 161.

The filter support wall 48 may include a filter support groove 49 into which the second filter 161 is inserted. A plurality of filter support walls 48 may be provided.

The second filter 161 may be disposed between the plurality of filter support walls 48. The second filter 161 may be inserted into a space between the plurality of filter support walls 48. The second filter 161 may be fixed in the left-right direction by the filter support walls 48.

The filter support wall 48 each may be formed integrally with the side wall 42 and/or the bottom surface 41. The filter support wall 48 may include plastic or the like. The filter support wall 48 may be formed of a material that does not allow air to pass through. The filter support wall 48 may guide the air drawn into the chamber S through the inlet 20 to pass through the second filter 161.

The second filter assembly 160 may be arranged between the first filter assembly 150 and the fan device 100. The second filter 161 may be arranged between the first filter 151 and the fan device 100.

The second filter assembly 160 may be arranged between the inlet 20 and the fan device 100. The second filter assembly 160 may be disposed on a upstream side of the fan device 100.

The second filter 161 may be arranged between the inlet 20 and the fan device 100, thereby preventing noise generated from the fan device 100 from being exposed to the outside through the inlet 20. In other words, the second filter 161 may be arranged to shield noise generated from the fan device 100.

The second filter assembly 160 may be in contact with the first filter assembly 150. The second filter 161 may be fixed by the first filter assembly 150 in the vertical direction.

The second filter 161 may be arranged to be in contact with the intake grill 153. At least a portion of the intake grill 153 may be arranged to press against an upper surface 161*a* of the second filter 161. The second filter 161 may be fixed by the intake grill 153 in the vertical direction.

The intake grill 153 may include a first side 153*a*. The second filter 161 may include the upper surface 161*a* corresponding to the first side 153*a* of the intake grill 153. The first side 153*a* of the intake grill 153 and the upper surface 161*a* of the second filter 161 may be provided in the same shape and/or size. The first side 153*a* of the intake grill 153 and the upper surface 161*a* of the second filter 161 may be in contact with each other.

Figure 12:
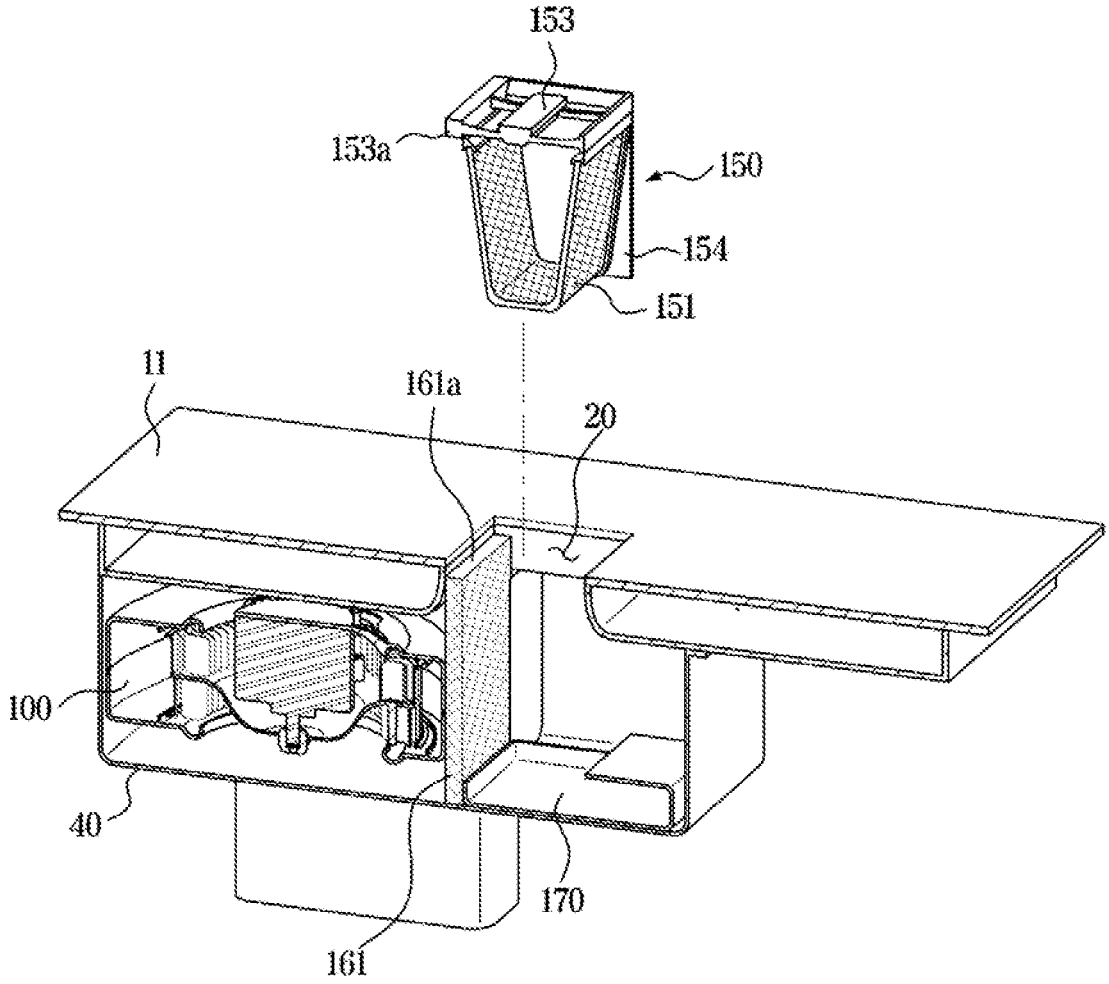
FIG. 12 is a view showing a first filter assembly separated from an inlet according to an embodiment of the present disclosure.
Figure 13:
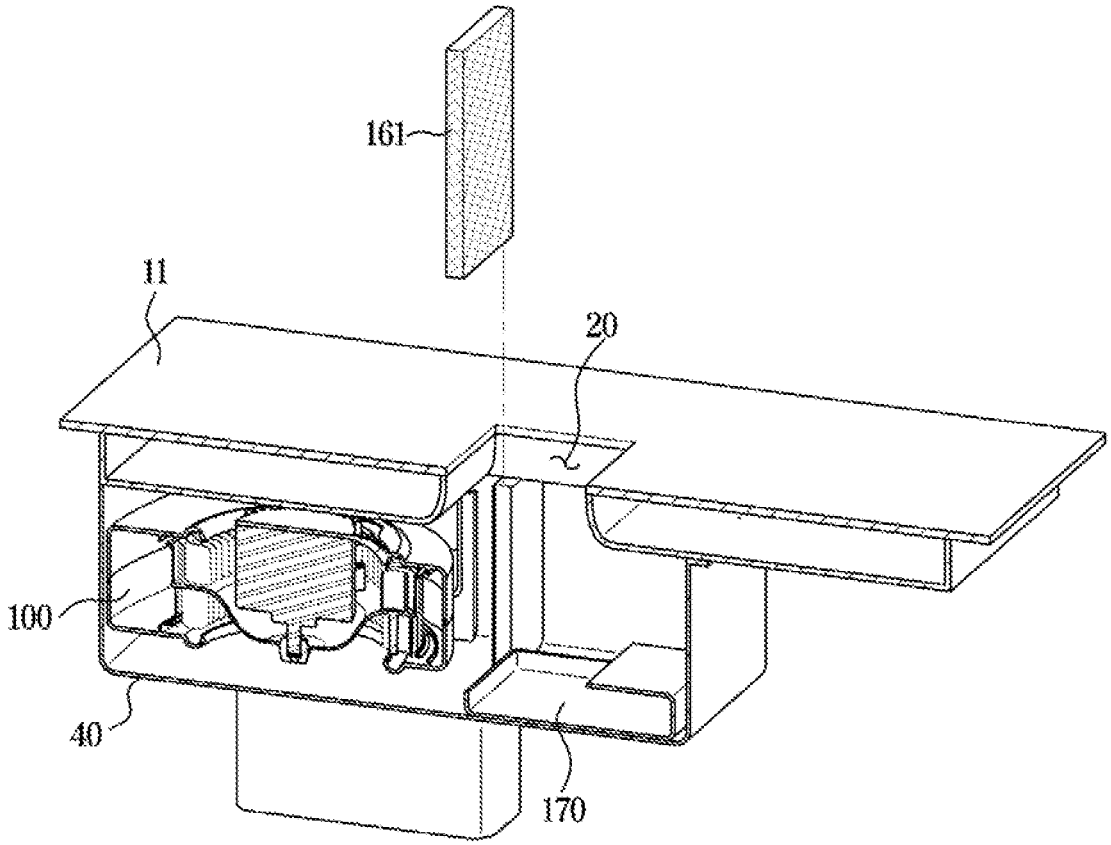
FIG. 13 is a view showing a second filter assembly separated from the inlet according to an embodiment of the present disclosure.

FIG. 12 is a view showing the first filter assembly separated from the inlet according to an embodiment of the present disclosure. FIG. 13 is a view showing the second filter assembly separated from the inlet according to an embodiment of the present disclosure.

The filters may need to be replaced periodically. To this end, the filter may be removable from the inlet 20.

A user may remove the first filter assembly 150 mounted on the inlet 20 from the inlet 20. By removing the intake grill 153 from the inlet 20, the filter frame 154 and the first filter 151 coupled thereto may also be separated therefrom.

When the first filter assembly 150 is removed, the second filter 161 may be exposed to the outside through the inlet 20. The second filter 161 located at the lower portion of the intake grill 153 may be exposed to the outside.

The user may take the second filter 161 out through the inlet 20 to the outside. The second filter 161 may then be cleaned or replaced with a new filter and placed back inside the chamber S through the inlet 20, followed by the first filter assembly 150 being fitted in the inlet 20 to secure the second filter 161.

In other words, the second filter 161 may be attached by the first filter assembly 150, and be exposed to the outside when the first filter assembly 150 is separated, thereby being easily replaceable.

Figure 14:
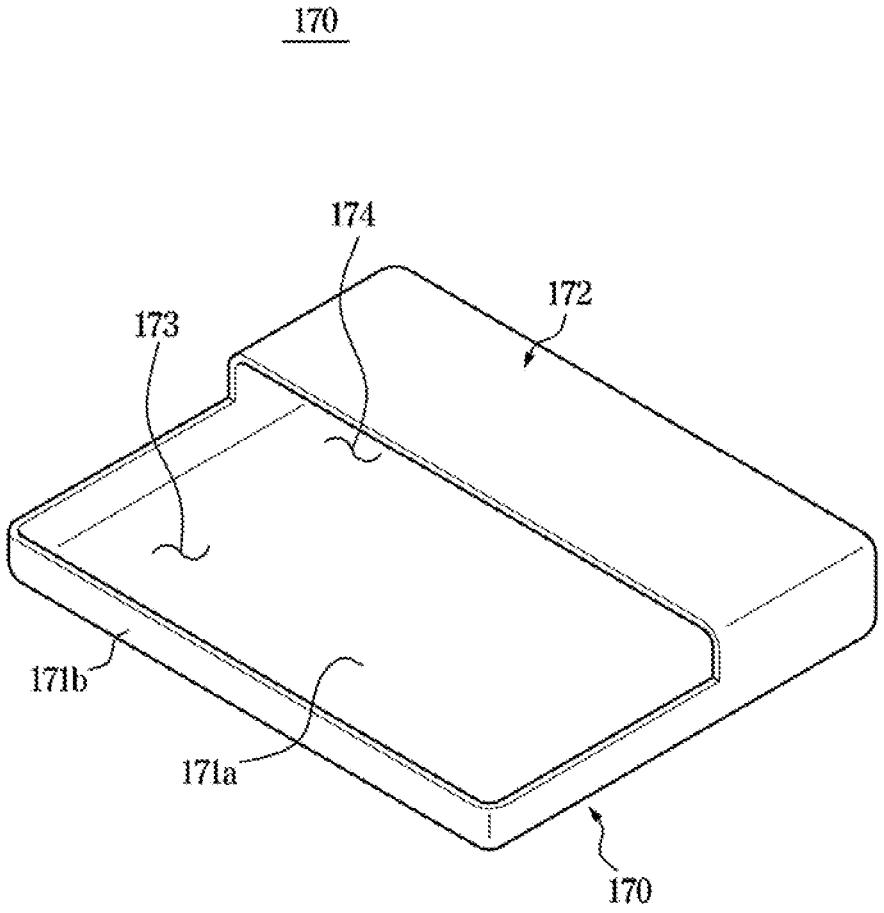
FIG. 14 is a perspective view of a water tray according to an embodiment of the present disclosure.

FIG. 14 is a perspective view of a water tray according to an embodiment of the present disclosure.

The cooking apparatus 1 may include a water tray 170. The water tray 170 may receive foreign substances, such as powder, crumbs, water, and the like generated during cooking. The water tray 170 may be disposed at a lower portion of the first filter assembly 21. The water tray 170 may be disposed inside the chamber housing 50.

The water tray 170 may be withdrawn through the inlet 20 during replacement and cleaning. The water tray 170 may be disposed at a lower portion of the inlet 20 for access through the inlet 20.

The water tray 170 may include a tray plate 171. The tray plate 171 may include a plate bottom surface 171*a* and a plate side wall 171*b*. The tray plate 171 may have an open top.

The plate bottom surface 171*a* and the plate side wall 171*b* may be provided to store water in the tray plate 171. The plate side wall 171*b* may extend upwardly from the plate bottom surface 171*a*.

The water tray 170 may include a tray cover 172 provided to cover at least a portion of the tray plate 171. The tray cover 172 may be provided to cover at least a portion of an opening formed in an upper portion of the tray plate 171.

The tray cover 172 may be formed integrally with the tray plate 171. However, the present disclosure is not limited thereto.

The tray cover 172 may be provided in the shape of a lid that covers at least a portion of the tray plate 171. The tray cover 172 may be connected to the tray plate 171. The tray cover 172 may extend from the side wall 171*b*. The tray cover 172 may be provided to cover a rear side of the tray plate 171.

The tray cover 172 may prevent water stored in the tray plate 171 from overflowing although the water tray 170 is tilted. The tray cover 172 may prevent water from overflowing by covering the opening of the tray plate 171.

The water tray 170 may include a plate receiving portion 173 and a cover receiving portion 174. The plate receiving portion 173 may refer to a space in which the tray plate 171 receives water when the water tray 170 is positioned horizontally, that is, when the plate bottom surface 171*a* is in contact with the bottom surface 41 of the chamber housing 40 in a parallel state.

When the water tray 170 is positioned vertically, that is, when the plate bottom surface 171*a* is perpendicular to the bottom surface of the chamber housing 40, the cover receiving portion 174 may refer to a space in which the tray plate 171 and the tray cover 172 receive water.

The cover receiving portion 174 may be provided to have a volume larger than that of the plate receiving portion 173. Accordingly, even if the water stored in the plate receiving portion 173 moves to the cover receiving portion 174 when the water tray 170 is tilted, the water may be prevented from overflowing.

Figure 15:
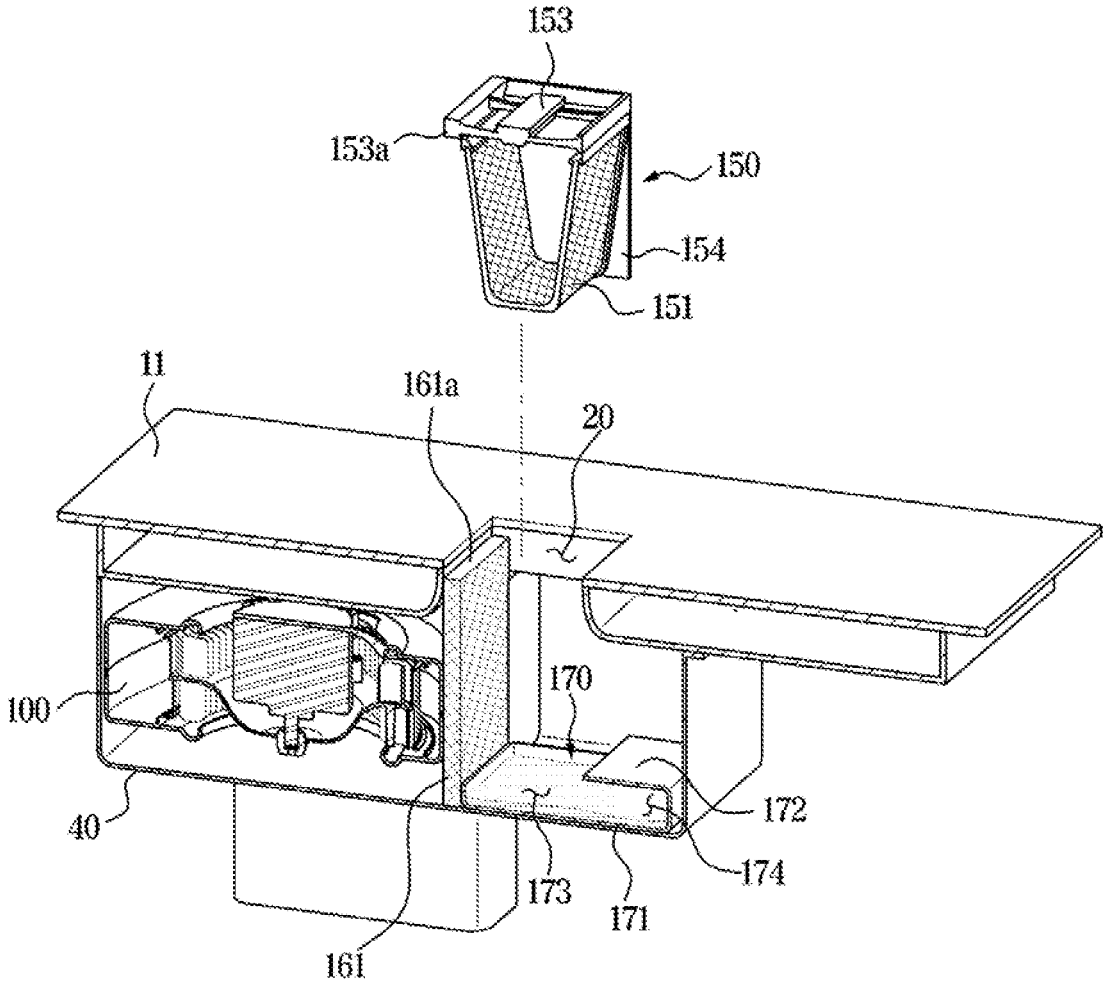
FIG. 15 is a view showing the first filter assembly separated from the inlet according to an embodiment of the present disclosure.
Figure 16:
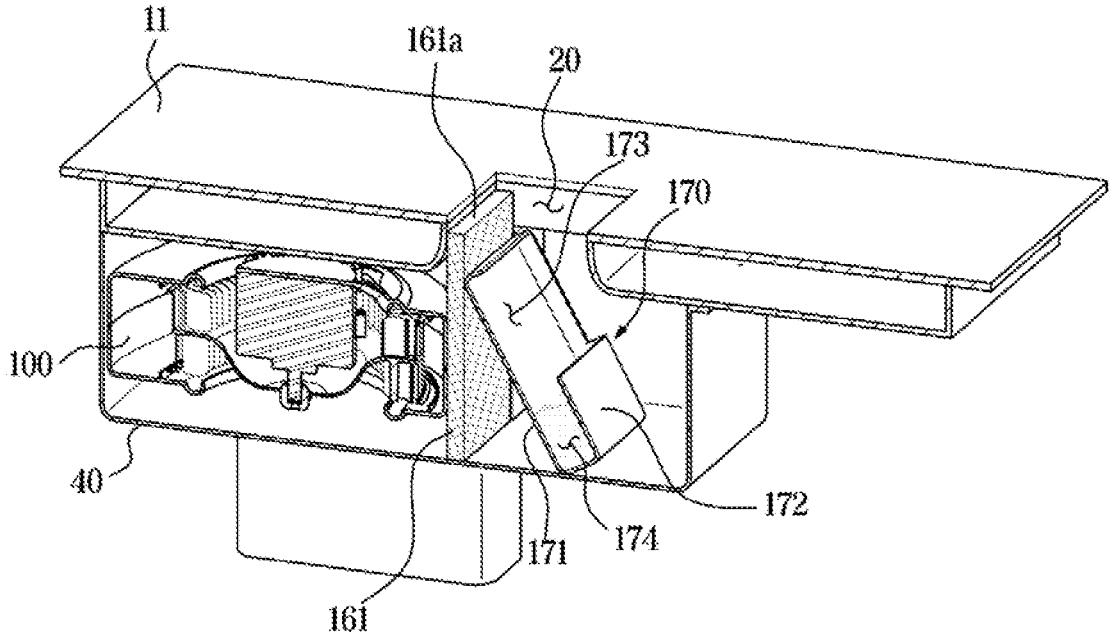
FIG. 16 is a view showing a tilted water tray according to an embodiment of the present disclosure.
Figure 17:
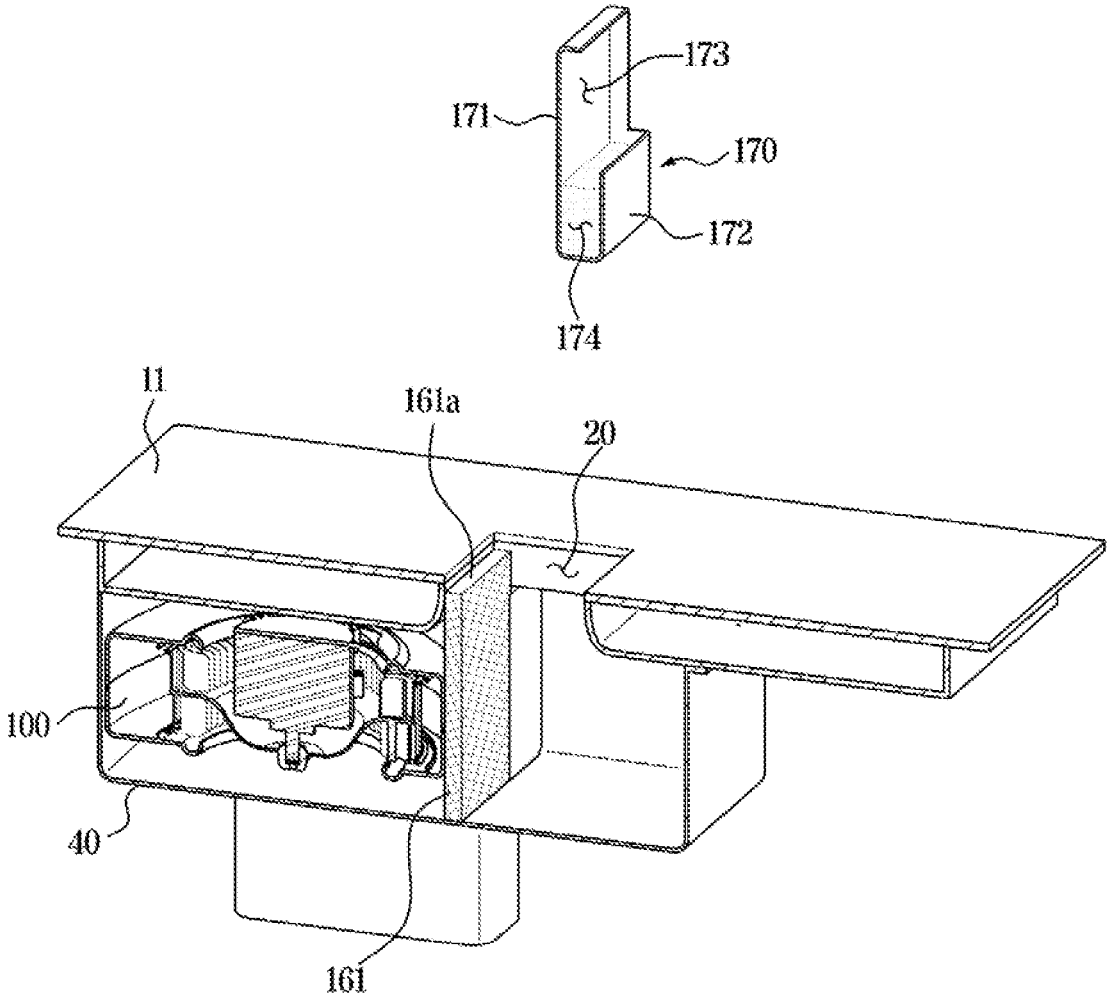
FIG. 17 is a view showing the water tray ejected from the inlet according to an embodiment of the present disclosure.

FIG. 15 is a view showing the first filter assembly removed from the inlet according to an embodiment of the present disclosure. FIG. 16 is a view showing the tilted water tray according to an embodiment of the present disclosure. FIG. 17 is a view showing the water tray withdrawn from the inlet according to an embodiment of the present disclosure.

During a cooking process, water or foreign substances may be entering through the inlet 20. Hereinafter, for the sake of convenience, an inflow of water will be described as an example. The water may pass through the first filter assembly 150 to move to the water tray 170 disposed at the lower portion of the first filter assembly 150. The water may be received in the plate receiving portion 173.

The user may perform the following process to remove the water stored in the water tray 170.

Referring to FIG. 15, the user may remove the first filter assembly 150 from the inlet 20.

Referring to FIG. 16, the user may tilt the water tray 170 to remove the water tray 170 from the inlet 20. At this time, the water collected in the plate receiving portion 173 may move to the cover receiving portion 174.

Referring to FIG. 17, the user may remove the water tray 170 from the inlet 20. However, the volume of the cover receiving portion 174 is larger than that of the plate receiving portion 173, so it is possible to prevent the water accumulated in the plate receiving portion 173 from overflowing although the water moves to the cover receiving portion 174.

The water tray 170 may be easily accessible from the inlet 20, and the user may easily remove the water stored in the water tray 170.

The cooking apparatus 1 according to an embodiment of the present disclosure may include the cooktop 10 with the inlet 20, the chamber housing 40 coupled to the cooktop 10 to form the chamber S into which air flows in through the inlet 20, the duct 60 guiding the air discharged from the chamber housing 40, and the fan device 100 disposed inside the chamber housing 40 to draw in air through the inlet 20 and discharge the drawn-in air into the duct 60, wherein the fan device 100 may include the fan 110, and the fan housing 120 covering the fan 110, the fan housing 120 including the first housing inlet 124 opening towards the cooktop 10 and the second housing inlet 126 opening in the direction opposite to the direction in which the first housing inlet 124 opens. According to the present disclosure, the fan device 100 is integrally formed and disposed inside the chamber housing 40, thereby improving ease of installation and enhancing performance.

The fan housing 120 may be spaced apart from the cooktop 10 so that the air drawn into the inlet 20 travels to the first housing inlet 124. The fan housing 120 may be spaced apart from the chamber housing 40 so that the air drawn into the inlet 20 travels to the second housing inlet 126. According to the present disclosure, air may be drawn into the first housing inlet 124 and the second housing inlet 126 of the fan housing 120, thereby improving intake performance and reducing noise.

The chamber housing 40 may further include the side wall 42 coupleable to the cooktop 10, the bottom surface 41 extending from the side wall 42 to face the inlet 20, and the support protrusion 43 protruding from the bottom surface 41 towards the cooktop 10, and the fan housing 120 may be seated on the support protrusion 43 to be spaced apart from the bottom surface 41. According to the present disclosure, the fan device 100 may be spaced apart from the bottom surface 41 of the chamber housing 40. As a result, air may be drawn into the second housing inlet 126 of the fan device 100.

The fan housing 120 may be provided to be coupleable to the support protrusion 43. According to the present disclosure, the fan device 100 may be easily coupled to the chamber housing 40, thereby improving the ease of installation, and the fan device 100 may be integrated as a unit, thereby reducing deviations in the performance of the fan 110.

The chamber housing 40 may further include the guide portion 46 provided to guide the position at which the fan housing 120 is seated on the support protrusion 43. The fan housing 120 may further include the housing outlet 127 and the flange 128 surrounding the housing outlet 127, the chamber housing 40 may further include the chamber outlet 45 formed on the side wall 42 to allow the air discharged through the housing outlet 127 to move to the duct 60, and the guide portion 46 may include the guide groove 47 disposed adjacent to the chamber outlet 45 to allow the flange 128 to be coupled. According to the present disclosure, the arrangement of the fan device 100 may be easily identified when the fan device 100 is coupled to the chamber housing 40. Furthermore, by inserting the flange 128 into the guide groove 47, the combining between the fan device 100 and the chamber housing 120 may be made more robust.

The fan device 100 may further include the fan motor 101 connected to the fan 110, and the fan housing 120 may further include the motor cover 125 provided on the first housing inlet 124 to cover the fan motor 101. According to the present disclosure, the fan motor 101 is covered by the fan housing 120 and/or the fan motor 101, thereby preventing the fan motor 101 from being exposed to the outside and protecting the fan motor 101.

The cooking apparatus 1 may include the first filter assembly 150 detachably coupled to the inlet 20 and the second filter assembly 160 disposed between the first filter assembly 150 and the fan device 100. According to the present disclosure, the second filter assembly 160 may be arranged between the inlet 20 and the fan device 100, thereby preventing noise generated from the fan device 100 from being transmitted to the inlet 20, resulting in noise reduction.

The first filter assembly 150 may include the first filter 151 and the first filter bracket 152 coupled to the inlet 20, the second filter assembly 160 may include the second filter 161 provided to filter air that has passed through the first filter 151, and the second filter 161 may be arranged to contact the first filter bracket 152. The first filter bracket 152 may be provided in a size corresponding to the inlet 20, and the second filter 161 may be provided in a size corresponding to at least a portion of the first filter bracket 152. According to the present disclosure, the second filter 161 may be secured by the first filter bracket 152, thereby facilitating the process of inserting and securing the second filter 161 into the chamber housing 140.

The cooking apparatus 1 may further include the water tray 170 disposed within the chamber housing 40, and the water tray 170 may be provided to be drawn in or out through the inlet 20. According to the present disclosure, the stored water may be easily removed by separating the water tray 170 through the inlet 20.

The water tray 170 may include the tray plate 171 including the opening formed at the upper portion to store water, and the tray cover 172 covering at least a portion of the opening to receive the water when the tray plate 171 is tilted. The tray plate 171 and the tray cover 172 may be formed as one piece. According to the present disclosure, even if the water tray 170 is tilted to be withdrawn through the inlet 20, the water stored in the water tray 170 may be prevented from overflowing.

The cooking apparatus 1 according to an embodiment of the present disclosure may include the top plate 11 on which the cookware 2 is placed, the cooktop 10 including the inlet 20 formed to penetrate the top plate 11 in one direction so as to drawn in air around the top plate 11, the chamber housing 40 coupled to the cooktop 10 to form the chamber S into which air flows through the inlet 20, the duct 60 guiding the air discharged from the chamber housing 40, the fan 110 disposed inside the chamber housing 40 to draw in air through the inlet 20 and discharge the drawn-in air into the duct 60 and including the first intake portion 114 and the second intake portion 115 disposed along the one direction, the first flow path F1 formed inside the chamber housing 40 and provided to allow air flowing into the inlet 20 to travel to the first intake portion 114 of the fan 110, and the second flow path F2 provided so that the air flowing into the inlet 20 travels to the second intake portion 115 of the fan 110 and partitioned from the first flow path F1 by the fan 110. According to the present disclosure, air may flow to the first flow path F1 and the second flow path F2 and be drawn into the fan 110, thereby improving intake performance and reducing noise.

The cooking apparatus 1 may further include the fan housing 120 including the first housing inlet 124 provided to cover the fan 110 and provided to correspond to the first intake portion 114 of the fan 110, and the second housing inlet 126 provided to correspond to the second intake portion 115 of the fan 110. According to the present disclosure, air may be drawn into the first housing inlet 124 and the second housing inlet 126 of the fan housing 120, thereby improving intake performance and reducing noise.

The chamber housing 40 may further include the side wall 42 coupleable to the cooktop 10, the bottom surface 41 extending from the side wall 42 to face the inlet 20, and the support protrusion 43 protruding from the bottom surface 41 towards the cooktop 10, and the fan housing 120 may be seated on the support protrusion 43 to be spaced apart from the bottom surface 41. According to the present disclosure, the fan device 100 may be spaced apart from the bottom surface 41 of the chamber housing 40. As a result, air may be drawn into the second housing inlet 126 of the fan device 100.

The fan housing 120 may be provided to be coupled to the support protrusion 43, and the chamber housing 40 may further include the guide portion 46 provided to guide the position at which the fan housing 120 is seated on the support protrusion 43.

The cooking apparatus 1 may further include the water tray 170 disposed within the chamber housing 40 and provided to be drawn in or out through the inlet 20, and the water tray 170 may include the tray plate 171 including the opening formed at the upper portion to store water and the tray cover 172 covering at least a portion of the opening to receive the water when the tray plate 171 is tilted. According to the present disclosure, the stored water may be easily removed by separating the water tray 170 through the inlet 20, and even if the water tray 170 is tilted to be withdrawn through the inlet 20, the water stored in the water tray 170 may be prevented from overflowing.

The cooking apparatus 1 according to an embodiment of the present disclosure may include the cooktop 10 with the inlet 20, the chamber housing 40 coupled to the cooktop 10 to form the chamber S into which air flows in through the inlet 20, the duct 60 guiding the air discharged from the chamber housing 40, the fan 110 disposed inside the chamber housing 40 to draw in air through the inlet 20 and discharge the drawn-in air into the duct 60, the fan housing 120 including the first housing inlet 124 opening towards the cooktop 10 and the second housing inlet 126 opening in the direction opposite to the direction in which the first housing inlet 124 opens, the first filter assembly 150 detachably coupled to the inlet 20, and the second filter assembly 160 disposed between the first filter assembly 150 and the fan housing 120 and in contact with the first filter assembly 150. According to the present disclosure, air may be drawn into the first housing inlet 124 and the second housing inlet 126 of the fan housing 120, thereby improving intake performance and reducing noise. In addition, the second filter assembly 160 may be arranged between the inlet 20 and the fan device 100, thereby preventing noise generated from the fan device 100 from being transmitted to the inlet 20, resulting in noise reduction. In addition the second filter 161 may be secured by the first filter bracket 152, thereby facilitating the process of inserting and securing the second filter 161 into the chamber housing 140.

According to the spirit of the present disclosure, the performance of the fan can be improved.

According to the spirit of the present disclosure, the performance of the fan may be improved.

According to the spirit of the present disclosure, noise generated from the fan may be reduced.

According to the spirit of the present disclosure, attachment and detachment of the filter may be facilitated.

According to the spirit of the present disclosure, the insertion and removal of the water tray may be facilitated.

While the present disclosure has been particularly described with reference to exemplary embodiments, it should be understood by those of skilled in the art that various changes in form and details may be made without departing from the spirit and scope of the present disclosure.

The invention claimed is:

1. A cooking apparatus, comprising:

a cooktop including an inlet;

a chamber housing to which a duct is connectable, the chamber housing coupled to the cooktop to form a chamber under the inlet; and a fan device inside the chamber housing, the fan device including:

a fan, and a fan housing covering the fan, the fan housing including:

a first housing inlet opening towards the cooktop, and a second housing inlet opening in a direction opposite to a direction in which the first housing inlet opens, wherein the fan device is operable to, with the duct being connected to the chamber housing:

draw air through the inlet into the chamber, so that some of the air drawn into the chamber is drawn through the first housing inlet into the fan housing, and other of the air drawn into the chamber is drawn through the second housing inlet into the fan housing, and discharge the air in the fan housing through the duct, wherein the fan housing is spaced apart from the chamber housing so that the other of the air drawn into the chamber is drawn through the second housing inlet, wherein the chamber housing includes:

a side wall coupled to the cooktop, a bottom surface connected to the side wall and disposed to face the inlet, and a support protrusion protruding from the bottom surface towards the cooktop, and wherein the fan housing is seated on the support protrusion to be spaced apart from the bottom surface.

2. The cooking apparatus of claim 1, wherein the fan housing is spaced apart from the cooktop so that the some of the air drawn into the chamber is drawn through the first housing inlet.

3. The cooking apparatus of claim 1, wherein the fan housing is configured to be coupleable to the support protrusion.

4. The cooking apparatus of claim 1, wherein the chamber housing includes a guide portion configured to guide a seating of the fan housing on the support protrusion.

5. The cooking apparatus of claim 4, wherein
the fan housing includes:
a housing outlet through which the air in the fan housing is discharged, and
a flange surrounding the housing outlet,
the chamber housing includes a chamber outlet on the side wall through which air discharged through the housing outlet moves to the duct, and
the guide portion includes a guide groove adjacent to the chamber outlet, and configured so that the flange is couplable to the guide groove.

6. The cooking apparatus of claim 1, wherein
the fan device includes a fan motor connected to the fan, and
the fan housing includes a motor cover disposed on the first housing inlet to cover the fan motor.

7. A cooking apparatus, comprising:
a cooktop including an inlet;
a chamber housing to which a duct is connectable, the chamber housing coupled to the cooktop to form a chamber under the inlet;
a fan device inside the chamber housing, the fan device including:
a fan, and
a fan housing covering the fan, the fan housing including;
a first housing inlet opening towards the cooktop, and
a second housing inlet opening in a direction opposite to a direction in which the first housing inlet opens,
a first filter assembly detachably couplable to the inlet; and
a second filter assembly disposed between the first filter assembly and the fan device when the first filter assembly is detachably coupled to the inlet,
wherein the fan device is operable to, with the duct being connected to the chamber housing:
draw air through the inlet into the chamber, so that some of the air drawn into the chamber is drawn through the first housing inlet into the fan housing, and other of the air drawn into the chamber is drawn through the second housing inlet into the fan housing, and
discharge the air in the fan housing through the duct,
wherein the first filter assembly includes:
a first filter, and
a first filter bracket couplable to the inlet, and on which the first filter is mountable so that the air drawn through the inlet into the chamber passes through the first filter, and
wherein the second filter assembly includes:
a second filter configured to filter the air that passes through the first filter, the second filter disposed to contact the first filter bracket.

8. The cooking apparatus of claim 7, wherein
the first filter bracket has a size corresponding to the inlet, and
the second filter has a size corresponding to at least a portion of the first filter bracket.

9. A cooking apparatus, comprising:
a cooktop including an inlet;
a chamber housing to which a duct is connectable, the chamber housing coupled to the cooktop to form a chamber under the inlet;
a fan device inside the chamber housing, the fan device including:
a fan, and
a fan housing covering the fan, the fan housing including:
a first housing inlet opening towards the cooktop, and
a second housing inlet opening in a direction opposite to a direction in which the first housing inlet opens, and
a water tray disposed inside the chamber housing,
wherein the water tray is movable through the inlet,
wherein the fan device is operable to, with the duct being connected to the chamber housing:
draw air through the inlet into the chamber, so that some of the air drawn into the chamber is drawn through the first housing inlet into the fan housing, and other of the air drawn into the chamber is drawn through the second housing inlet into the fan housing, and
discharge the air in the fan housing through the duct, and
wherein the water tray includes:
a tray plate having an opening at an upper portion to store water, and
a tray cover covering at least a portion of the upper portion so as to accommodate water when the tray plate is tilted.

10. The cooking apparatus of claim 9, wherein
the tray plate and the tray cover are integrally formed.

* * * * *